US008620643B1

(12) United States Patent
Ludwig

(10) Patent No.: US 8,620,643 B1
(45) Date of Patent: Dec. 31, 2013

(54) AUDITORY EIGENFUNCTION SYSTEMS AND METHODS

(75) Inventor: Lester F. Ludwig, Belmont, CA (US)

(73) Assignee: Lester F. Ludwig, Belmont, CA (US)

( * ) Notice: Subject to any disclaimer, the term of this patent is extended or adjusted under 35 U.S.C. 154(b) by 284 days.

(21) Appl. No.: 12/849,013

(22) Filed: Aug. 2, 2010

Related U.S. Application Data

(60) Provisional application No. 61/273,182, filed on Jul. 31, 2009.

(51) Int. Cl.
*G10L 19/00* (2013.01)
*G10L 19/02* (2013.01)

(52) U.S. Cl.
USPC ..... 704/200.1; 704/206; 704/211

(58) Field of Classification Search
USPC ..... 704/200.1, 204, 205, 206, 500, 501, 704/211
See application file for complete search history.

(56) References Cited

U.S. PATENT DOCUMENTS

| | | | | |
|---|---|---|---|---|
| 5,090,418 | A * | 2/1992 | Squires et al. | 600/515 |
| 5,705,824 | A * | 1/1998 | Lafrate et al. | 257/23 |
| 5,712,956 | A * | 1/1998 | Yamada et al. | 704/234 |
| 5,946,038 | A * | 8/1999 | Kalker | 375/240.1 |
| 6,055,502 | A * | 4/2000 | Kitamura | 704/500 |
| 6,263,306 | B1 * | 7/2001 | Fee et al. | 704/203 |
| 6,351,729 | B1 * | 2/2002 | Thomson | 704/206 |
| 6,725,190 | B1 * | 4/2004 | Chazan et al. | 704/205 |
| 7,346,137 | B1 * | 3/2008 | Cvetkovic | 375/350 |
| 8,160,274 | B2 * | 4/2012 | Bongiovi | 381/98 |
| 2003/0236072 | A1 * | 12/2003 | Thomson | 455/63.1 |
| 2005/0149902 | A1 * | 7/2005 | Shi et al. | 716/21 |
| 2005/0204286 | A1 * | 9/2005 | Buhrke | 715/706 |
| 2006/0025989 | A1 * | 2/2006 | Mesgarani et al. | 704/200 |
| 2006/0190257 | A1 * | 8/2006 | Forbes et al. | 704/255 |
| 2007/0117030 | A1 * | 5/2007 | Laidig et al. | 430/5 |
| 2007/0214133 | A1 * | 9/2007 | Liberty et al. | 707/5 |
| 2008/0228471 | A1 * | 9/2008 | Cabot et al. | 704/203 |
| 2009/0210080 | A1 * | 8/2009 | Basson et al. | 700/94 |
| 2010/0004769 | A1 * | 1/2010 | Holden et al. | 700/97 |
| 2010/0260301 | A1 * | 10/2010 | Galbally et al. | 376/247 |

OTHER PUBLICATIONS

Rabenstein et al., "Digital Sound Synthesis of String Vibrations with Physical and Psychoacoustic Models", ISCCSP 2008, Mar. 12-14, 2008, pp. 1302 to 1307.*

Lecture 5: Eigenfunctions and Eigenvalues, retrieved from http://depts.washington.edu/chemcrs/bulkdisk/chem455A_aut10/notes_Lecture%20%205.pdf on Jan. 11, 2013, 10 Pages.*

(Continued)

*Primary Examiner* — Martin Lerner
(74) *Attorney, Agent, or Firm* — Procopio, Cory, Hargreaves & Savitch LLP

(57) ABSTRACT

A computer numerical processing method for representing audio information for use in conjunction with human hearing is described. The method comprises approximating an eigenfunction equation representing a model of human hearing, calculating the approximation to each of a plurality of eigenfunctions from at least one aspect of the eigenfunction equation, and storing the approximation to each of a plurality of eigenfunctions for use at a later time. The approximation to each of a plurality of eigenfunctions represents audio information. The model of human hearing includes a bandpass operation with a bandwidth having the frequency range of human hearing and a time-limiting operation approximating the time duration correlation window of human hearing.

19 Claims, 29 Drawing Sheets

(56) References Cited

OTHER PUBLICATIONS

The Operator Postulate, Quantum Mechanics Postulates, retrieved from http://hyperphysics.phy-str.gus.edu/hbase/quantum/qm2.html on Jan. 11, 2013, 4 Pages.*

Salimpour et al. "Auditory Wavelet Transform." The 3rd European Medical and Biological Engineering Conference, Nov. 20-25, 2005.

Salimpour et al. "Auditory Wavelet Transform Based on Auditory Wavelet Families." Proceedings of the 28th IEEE, EMBS Annual International Conference, New York, NY, Aug. 30, 2006.

Lin et al. "Analog VLSI Implementations of Auditory Wavelet Transforms Using Switched-Capacitor Circuits." IEEE Transactions on Circuits and Systems—1: Fundamental Theory and Applications, vol. 41, No. 9, Sep. 1994.

"Basis Function." Downloaded from http://en.wikipedia.org/wiki/Basis_function on Nov. 26, 2012.

"Eigenfunction." Downloaded from http://en.wikipedia.org/wiki/Eigenfunction on Nov. 26, 2012.

* cited by examiner

| Basis Functions | Advantages | Degeneracy |
|---|---|---|
| Fourier Series: $\frac{1}{\sqrt{2\pi}}e^{int}, n \in Z$ | *Linear Differential Equations Natural Modes<br>*Linear circuits<br>*Audio tone controls, equalization principles, resonance, etc. | derivatives are eigenfncs |
| Hermite Function Series: $e^{\frac{-t^2}{2}} H_n(t), n \in nonnegativeZ$ | *Diagonalizes the infinite continous Fourier Tranform Operation | yes (repeated eigenvalues) |
| Prolate Spheroidal WF Series: $\psi_n(t,c), n \in nonnegativeZ$ | *Diagonalizes the finite continous Fourier Tranform Operation | no |
| Auditory Eigenfunctions Series: $\phi_n(t), n \in nonnegativeZ$ | *Diagonalizes the "auditory perception" operation<br>*Natural modes of "auditor perception" | likely |

Figure 12a

$[u(m) + \cos(2\pi mt)]\phi_n(t)$ where $m \in (Critical\ \ Bands)\boldsymbol{M}$ $n \in (Prolat\ \ Index)\boldsymbol{Z}$ and $u$ is a function of unity $\sum_{M \in M_1} u(m) = 1$

AUDITORY EIGENFUNCTION SYSTEMS AND METHODS

CROSS-REFERENCE TO RELATED APPLICATIONS

This application claims benefit of priority of U.S. provisional application Ser. No. 61/273,182 filed on Jul. 31, 2009, incorporated herein by reference.

BACKGROUND OF THE INVENTION

1. Field of the Invention

This invention relates to the dynamics of time-limiting and frequency-limiting properties in the hearing mechanism auditory perception, and in particular to a Hilbert space model of at least auditory perception, and further as to systems and methods of at least signal processing, signal encoding, user/machine interfaces, data sonification, and human language design.

2. Background of the Invention

Most of the attempts to explain attributes of auditory perception are focused on the perception of steady-state phenomenon. These tend to separate affairs in time and frequency domains and ignore their interrelationships. A function cannot be both time and frequency-limited, and there are tradeoffs between these limitations.

The temporal and pitch perception aspects of human hearing comprise a frequency-limiting property or behavior in the frequency range between approximately 20 Hz and 20 KHz. The range slightly varies for each individual's biological and environmental factors, but human ears are not able to detect vibrations or sound with lesser or greater frequency than in roughly this range. The temporal and pitch perception aspects of human hearing also comprise a time-limited property or behavior in that human hearing perceives and analyzes stimuli within a time correlation window of 50 msec (sometimes called the "time constant" of human hearing). A periodic audio stimulus with period of vibration faster than 50 msec is perceived in hearing as a tone or pitch, while a periodic audio stimulus with period of vibration slower than 50 msec will either not be perceived in hearing or will be perceived in hearing as a periodic sequence of separate discrete events. The ~50 msec time correlation window and the ~20 Hz lower frequency limit suggest a close interrelationship in that the period of a 20 Hz periodic waveform is in fact 50 msec.

As will be shown, these can be combined to create a previously unknown Hilbert-space of eigenfunctions modeling auditory perception. This new Hilbert-space model can be used to study aspects of the signal processing structure of human hearing. Further, the resulting eigenfunctions themselves may be used to create a wide range of novel systems and methods signal processing, signal encoding, user/machine interfaces, data sonification, and human language design.

Additionally, the ~50 msec time correlation window and the ~20 Hz lower frequency limit appear to be a property of the human brain and nervous system that may be shared with other senses. As a result, the Hilbert-space of eigenfunctions may be useful in modeling aspects of other senses, for example, visual perception of image sequences and motion in visual image scenes.

For example, there is a similar ~50 msec time correlation window and the ~20 Hz lower frequency limit property in the visual system. Sequences of images, as in a flipbook, cinema, or video, start blending into perceived continuous image or motion as the frame rate of images passes a threshold rate of about 20 frames per second. At 20 frames per second, each image is displayed for 50 msec. At a slower rate, the individual images are seen separately in a sequence while at a faster rate the perception of continuous motion improves and quickly stabilizes. Similarly, objects in a visual scene visually oscillating in some attribute (location, color, texture, etc.) at rates somewhat less than ~20 Hz can be followed by human vision, but at oscillation rates approaching ~20 Hz and above human vision perceives these as a blur.

SUMMARY OF THE INVENTION

The invention comprises a computer numerical processing method for representing audio information for use in conjunction with human hearing. The method includes the steps of approximating an eigenfunction equation representing a model of human hearing, calculating the approximation to each of a plurality of eigenfunctions from at least one aspect of the eigenfunction equation, and storing the approximation to each of a plurality of eigenfunctions for use at a later time. The approximation to each of a plurality of eigenfunctions represents audio information.

The model of human hearing includes a bandpass operation with a bandwidth having the frequency range of human hearing and a time-limiting operation approximating the time duration correlation window of human hearing.

In another aspect of the invention, a method for representing audio information for use in conjunction with human hearing includes retrieving a plurality of approximations, each approximation corresponding with one of a plurality of eigenfunctions previously calculated, receiving incoming audio information, and using the approximation to each of a plurality of eigenfunctions to represent the incoming audio information by mathematically processing the incoming audio information together with each of the retrieved approximations to compute a coefficient associated with the corresponding eigenfunction and associated the time of calculation, the result comprising a plurality of coefficient values associated with the time of calculation.

Each approximation results from approximating an eigenfunction equation representing a model of human hearing, wherein the model comprises a bandpass operation with a bandwidth including the frequency range of human hearing and a time-limiting operation approximating the time duration correlation window of human hearing.

The plurality of coefficient values is used to represent at least a portion of the incoming audio information for an interval of time associated with the time of calculation.

In yet another aspect of the invention, the method for representing audio information for use in conjunction with human hearing includes retrieving a plurality of approximations, receiving incoming coefficient information, and using the approximation to each of a plurality of eigenfunctions to produce outgoing audio information by mathematically processing the incoming coefficient information together with each of the retrieved approximations to compute the value of an additive component to an outgoing audio information associated an interval of time, the result comprising a plurality of coefficient values associated with the calculation time.

Each approximation corresponds with one of a plurality of previously calculated eigenfunctions, and results from approximating an eigenfunction equation representing a model of human hearing. The model of human hearing includes a bandpass operation with a bandwidth having the frequency range of human hearing and a time-limiting operation approximating the time duration correlation window of human hearing.

The plurality of coefficient values is used to produce at least a portion of the outgoing audio information for an interval of time.

BRIEF DESCRIPTION OF THE DRAWINGS

The above and other aspects, features, and advantages of the present invention will become more apparent upon consideration of the following description of preferred embodiments, taken in conjunction with the accompanying drawing figures.

FIG. 12*a* depicts a table comparing basis function arrangements associated with Fourier Series, Hermite function series, Prolate Spheriodal Wave Function series, and the invention's auditory eigenfunction series.

DETAILED DESCRIPTION

In the following detailed description, reference is made to the accompanying drawing figures which form a part hereof, and which show by way of illustration specific embodiments of the invention. It is to be understood by those of ordinary skill in this technological field that other embodiments can be utilized, and structural, electrical, as well as procedural changes can be made without departing from the scope of the present invention. Wherever possible, the same element reference numbers will be used throughout the drawings to refer to the same or similar parts.

1. A Primitive Empirical Model of Human Hearing

Figure 1A:
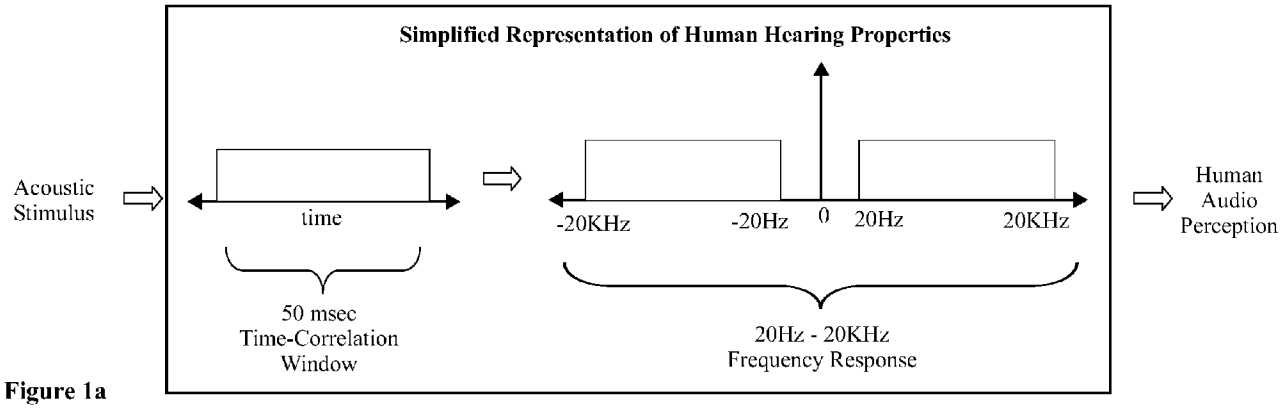
FIG. 1*a* depicts a simplified model of the temporal and pitch perception aspects of the human hearing process.

A simplified model of the temporal and pitch perception aspects of the human hearing process useful for the initial purposes of the invention is shown in FIG. 1*a*. In this simplified model, external audio stimulus is projected into a "domain of auditory perception" by a confluence of operations that empirically exhibit a 50 msec time-limiting "gating" behavior and 20 Hz-20 kHz "band-pass" frequency-limiting behavior. The time-limiting gating operation and frequency-limiting band-pass operations are depicted here as simple on/off conditions—phenomenon outside the time gate interval are not perceived in the temporal and pitch perception aspects of the human hearing process, and phenomenon outside the band-pass frequency interval are not perceived in the temporal and pitch perception aspects of the human hearing process.

Figure 1B:
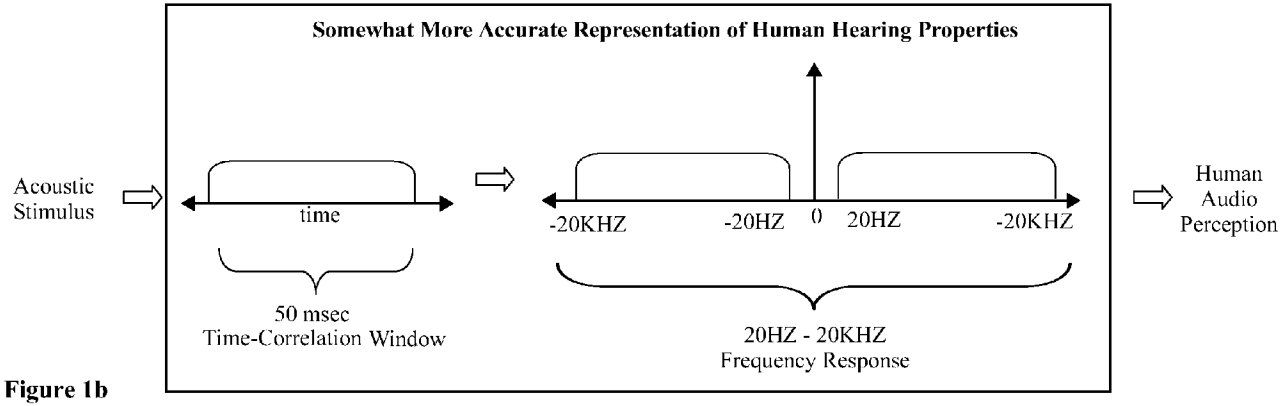
FIG. 1*b* shows a slightly modified version of the simplified model of FIG. 1*a* comprising smoother transitions at time-limiting and frequency-limiting boundaries.

FIG. 1*b* shows a slightly modified (and in a sense more "refined") version of the simplified model of FIG. 1*a*. Here the time-limiting gating operation and frequency-limiting band-pass operations are depicted with smoother transitions at their boundaries.

2. Towards an Associated Hilbert Space Auditory Eigenfunction Model of Human Hearing As will be shown, these simple properties, together with an assumption regarding aspects of linearity can be combined to create a Hilbert-space of eigenfunctions modeling auditory perception.

The Hilbert space model is built on three of the most fundamental empirical attributes of human hearing:

a. the aforementioned approximate 20 Hz-20 KHz frequency range of auditory perception [1] (and its associated 'bandpass' frequency limiting operation);
b. the aforementioned approximate 50 msec time-correlation window of auditory perception [2]; and,
c. the approximate wide-range linearity (modulo post-summing logarithmic amplitude perception) when several signals are superimposed [1-2].

These alone can be naturally combined to create a Hilbert-space of eigenfunctions modeling auditory perception. Additionally, there are at least two ways such a model can be applied to hearing:

- a wideband version wherein the model encompasses the entire audio range; and
- an aggregated multiple parallel narrow-band channel version wherein the model encompasses multiple instances of the Hilbert space, each corresponding to an effectively associated 'critical band' [2].

As is clear to one familiar with eigensystems, the collection of eigenfunctions is the natural coordinate system within the space of all functions (here, signals) permitted to exist within the conditions defining the eigensystem. Additionally, to the extent the eigensystem imposes certain attributes on the resulting Hilbert space, the eigensystem effectively defines the aforementioned "rose colored glasses" through which the human experience of hearing is observed.

3. Auditory Eigenfunction Model of Human Hearing Versus "Auditory Wavelets"

The popularity of time-frequency analysis [41-42], wavelet analysis, and filter banks has led to a remotely similar type of idea for a mathematical analysis framework that has some sort of indigenous relation to human hearing [46]. Early attempts were made to implement an electronic cochlea [42-45] using these and related frameworks. This segued into the notion of 'Auditory Wavelets' which has seen some level of treatment [47-49]. Efforts have been made to construct 'Auditory Wavelets' in such a fashion as to closely match various measured empirical attributes of the cochlea, and further to even apply these to applications of perceived speech quality [50] and more general audio quality [51].

Figure 2:
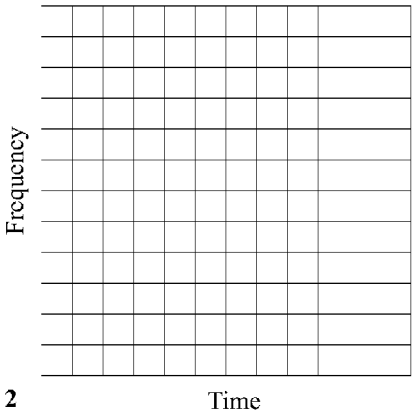
FIG. 2 depicts a partition of joint time-frequency space into an array of regional localizations in both time and frequency (often referred to in wavelet theory as a "frame").

The basic notion of wavelet and time frequency analysis involves localizations in both time and frequency domains [40-41]. Although there are many technicalities and extensive variations (notably the notion of oversampling), such localizations in both time and frequency domains create the notion of a partition of joint time-frequency space, usually rectangular grid or lattice (referred to as a "frame") as suggested by FIG. 2. If complete in the associated Hilbert space, wavelet systems are constructed from the bottom-up from a catalog of candidate time-frequency-localized scalable basis functions, typically starting with multi-resolution attributes, and are often over-specified (i.e., redundant) in their span of the associated Hilbert space.

In contrast, the present invention employs a completely different approach and associated outcome, namely determining the 'natural modes' (eigenfunctions) of the operations discussed above in sections 1 and 2. Because of the non-symmetry between the ('bandpass') Frequency-Limiting operation (comprising a 'gap' that excludes frequency values near and including zero frequency) and the Time-Limiting operation (comprising no such 'gap'), one would not expect a joint time-frequency space partition like that suggested by FIG. 2 for the collection of Auditory eigenfunctions.

4. Similarities to the ("Low Pass") Prolate Spheroidal Wavefunction Models of Slepian et al.

The aforementioned attributes of hearing {"a","b","c"} are not unlike those of the mathematical operator equation that gives rise to the Prolate Spheroidal Wave Functions (PSWFs):

1. Frequency Band Limiting from 0 to a finite angular frequency maximum value Ω (mathematically, within "complex-exponential" and Fourier transform frequency range [−Ω, Ω]);
2. Time Duration Limiting from −T/2 to +T/2 (mathematically, within time interval [−T/2, T/2]—the centering of the time interval around zero used to simplify calculations and to invoke many other useful symmetries);
3. Linearity, bounded energy (i.e., bounded $L^2$ norm).

Figure 3A:
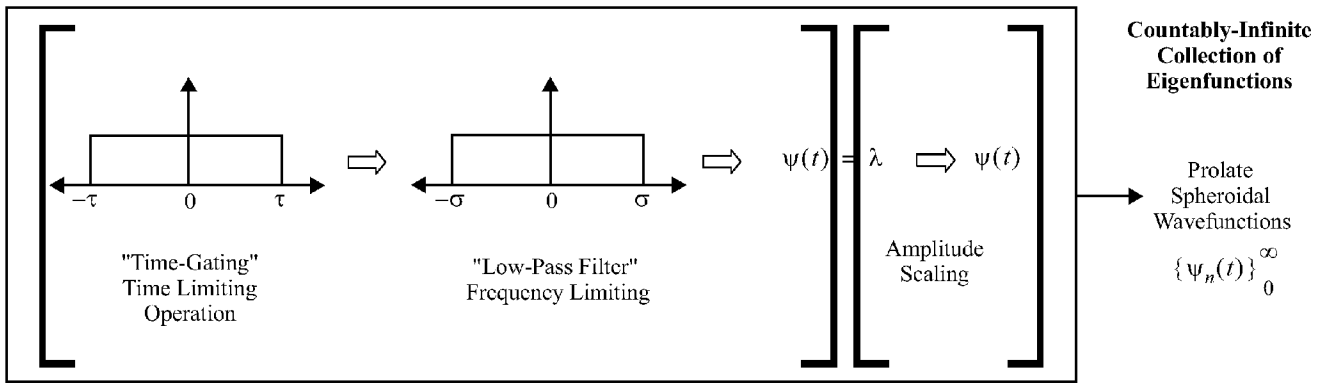
FIG. 3*a* figuratively illustrates the mathematical operator equation whose eigenfunctions are the Prolate Spheroidal Wave Functions (PSWFs).

This arrangement is figuratively illustrated in FIG. 3*a*.

In a series of celebrated papers beginning in 1961 ([1-3] among others), Slepian and colleagues at Bell Telephone Laboratories developed a theory of wide impact relating time-limited signals, band limited signals, the uncertainty principle, sampling theory, Sturm-Liouville differential equations, Hilbert space, non-degenerate eigensystems, etc., with what were at the time an obscure set of orthogonal polynomials (from the field of mathematical physics) known as Prolate Spheroidal Wave Functions. These functions and the mathematical framework that was subsequently developed around them have found widespread application and brim with a rich mix of exotic properties. The PSWF have since come to be widely recognized and have found a broad range of applications (for example [9,10] among many others).

The Frequency Band Limiting operation in the Slepian mathematics [3-5] is known from signal theory as an ideal Low-Pass filter (passing low frequencies and blocking higher frequencies, making a step on/off transition between frequencies passed and frequencies blocked). Slepian's PSWF mathematics combined the (low-pass) Frequency Band Limiting (denote that as B) and the Time Duration Limiting operation (denote that as D) to form an operator equation eigensystem problem:

$$BD[\psi_i](t)=\lambda_i\psi_i \tag{1}$$

to which the solutions $\psi_i$ are scalar multiples of the PSWFs. Here the $\lambda_i$ are the eigenvalues, the $\psi_i$ are the eigenfunctions, and the combination of these is the eigensystem.

Following Slepian's original notation system, the Frequency Band Limiting operation B can be mathematically realized as $$Bf(t) = \frac{1}{\sqrt{2\pi}}\int_{-\Omega}^{\Omega} F(w)e^{iwt}\,dw \tag{2}$$

where F is the Fourier transform of the function $f$, here normalized as $$F(w) = \int_{-\infty}^{\infty} f(t)e^{-iwt}\,dt. \tag{3}$$

As an aside, the Fourier transform $$F(w) = \int_{-\infty}^{\infty} f(t)e^{-iwt}\,dt. \tag{4}$$

maps a function in the Time domain into another function in the Frequency domain. The inverse Fourier transform $$f(t) = \frac{1}{2\pi}\int_{-\infty}^{\infty} F(w)e^{iwt}\,dw, \tag{5}$$

maps a function in the Frequency domain into another function in the Time domain. These roles may be reversed, and the Fourier transform can accordingly be viewed as mapping a function in the Frequency domain into another function in the Time domain. In overview of all this, often the Fourier transform and its inverse are normalized so as to look more similar $$f(t) = \frac{1}{\sqrt{2\pi}}\int_{-\infty}^{\infty} F(w)e^{iwt}\,dw \tag{6}$$

$$F(w) = \frac{1}{\sqrt{2\pi}}\int_{-\infty}^{\infty} f(t)e^{-iwt}\,dt. \tag{7}$$

(and more importantly to maintain the value of the $L^2$ norm under transformation between Time and Frequency domains), although Slepian did not use this symmetric normalization convention.

Returning to the operator equation $$BD[\psi_i](t)=\lambda_i\psi_i, \tag{8}$$

the Time Duration Limiting operation D can be mathematically realized as $$Df(t) = \begin{cases} f(t,) & |t| \le T/2 \\ 0, & |t| > T/2. \end{cases} \tag{9}$$

and some simple calculus combined with an interchange of integration order (justified by the bounded $L^2$ norm) and managing the integration variables among the integrals accurately yields the integral equation $$\lambda_i\psi_i(t) = \int_{-\frac{T}{2}}^{\frac{T}{2}} \frac{\sin\Omega(t-s)}{\pi(t-s)}\psi_i(s)\,ds,\ i = 0, 1, 2, \ldots\ . \tag{10}$$

as a representation of the operator equation $$BD[\psi_i](t)=\lambda_i\psi_i. \tag{11}$$

The ratio expression within the integral sign is the "sinc" function and in the language of integral equations its role is called the kernel. Since this "sinc" function captures the low-pass Frequency Band Limiting operation, it has become known as the "low-pass kernel."

Figure 3B:
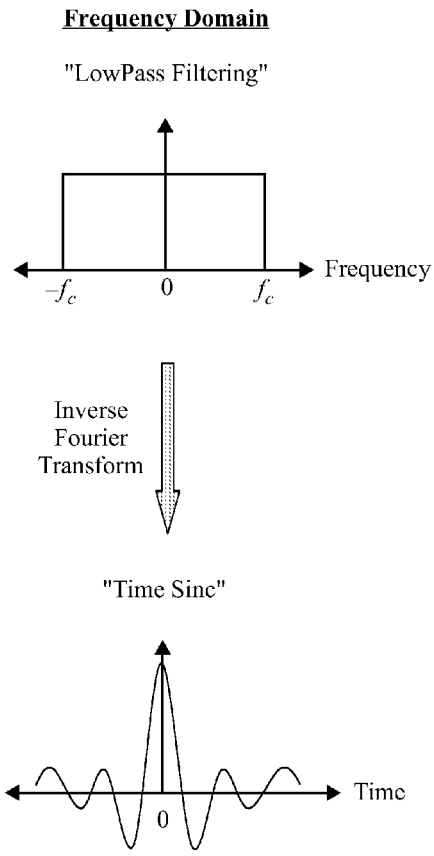
FIG. 3*b* shows the low-pass Frequency-Limiting operation and its Fourier transform and inverse Fourier transform (omitting scaling and argument sign details), the "sinc" function, which correspondingly exists in the Time domain.

FIG. 3*b* depicts an illustration the low-pass Frequency Band Limiting operation (henceforth "Frequency-Limiting" operation). In the frequency domain, this operation is known as a "gate function" and its Fourier transform and inverse Fourier transform (omitting scaling and argument sign details) is the "sinc" function in the Time domain. More detail will be provided to this in Section 8.

Figure 3C:
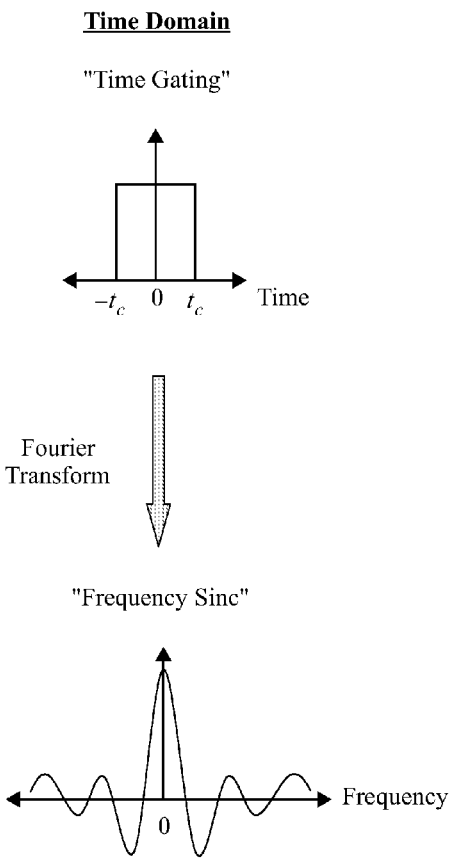
FIG. 3*c* shows the low-pass Time-Limiting operation and its Fourier transform and inverse Fourier transform (omitting scaling and argument sign details), the "sinc" function, which correspondingly exists in the Frequency domain.

A similar "gate function" structure also exists for the Time Duration Limiting operation (henceforth "Time-Limiting operation"). Its Fourier transform is (omitting scaling and argument sign details) the "sinc" function in the Frequency domain. FIG. 3*c* depicts an illustration of the low-pass Time-Limiting operation and its Fourier transform and inverse Fourier transform (omitting scaling and argument sign details), the "sinc" function, which correspondingly exists in the Frequency domain.

Figure 4:
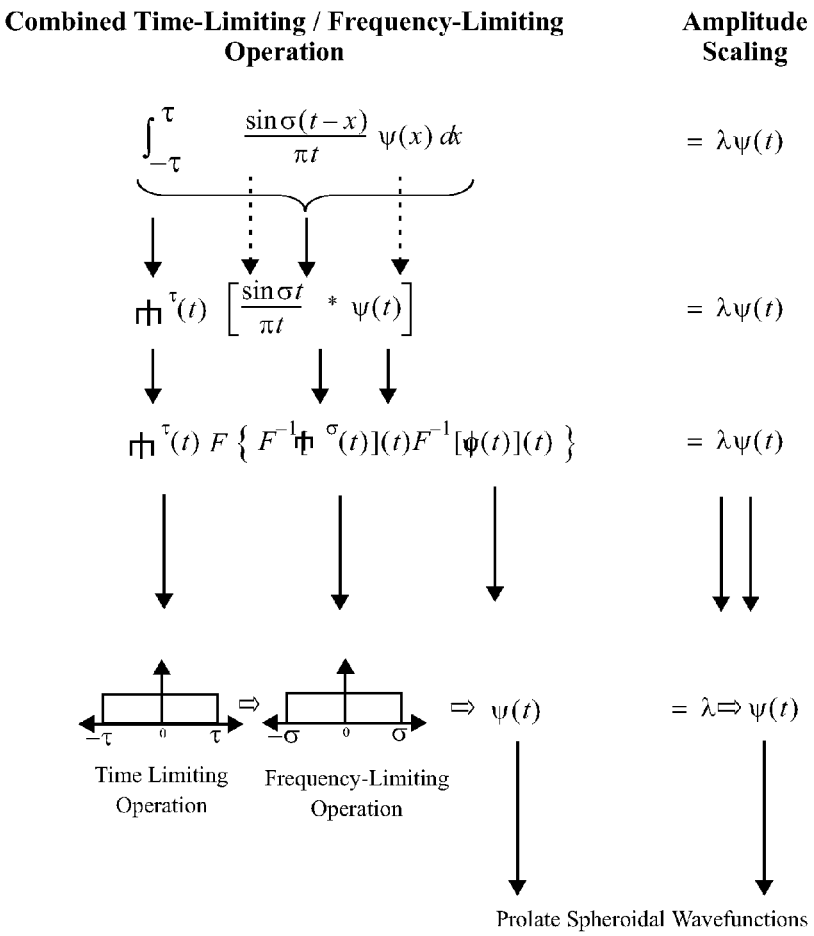
FIG. 4 summarizes the above construction of the low-pass kernel version of the operator equation $BD[\psi_i](t)=\lambda_i\psi_i$ resulting in solutions $\psi_i$ that are the Prolate Spheriodal Wave Functions ("PSWF").

FIG. 4 summarizes the above construction of the low-pass kernel version of the operator equation $$BD[\psi_i](t)=\lambda_i\psi_i, \tag{11}$$

(i.e., where B comprises the low-pass kernel) which may be represented by the equivalent integral equation $$\lambda_i\psi_i(t) = \int_{-\frac{T}{2}}^{\frac{T}{2}} \frac{\sin\Omega(t-s)}{\pi(t-s)}\psi_i(s)\,ds,\ i = 0, 1, 2, \ldots\ . \tag{12}$$

Here the Time-Limiting operation T is manifest as the limits of integration and the Band-Limiting operation B is manifest as a convolution with the Fourier transform of the gate function associated with B.

The integral equation of Eq. 12 has solutions $\psi_i$ in the form of eigenfunctions with associated eigenvalues. As will be described shortly, these eigenfunctions are scalar multiples of the PSWFs.

Classically [3], the PSWFs arise from the differential equation $$(1-t^2)\frac{d^2u}{dt^2} - 2t\frac{du}{dt} + (x - c^2t^2)u = 0 \tag{13}$$

When c is real, the differential equation has continuous solutions for the variable t over the interval [−1, 1] only for certain discrete real positive values of the parameter x (i.e., the eigenvalues of the differential equation). Uniquely associated with each eigenvalue is a unique eigenfunction that can be expressed in terms of the angular prolate spheroidal functions $S_{0n}(c,t)$. Among the vast number of interesting and useful properties of these functions are.

The $S_{0n}(c,t)$ are real for real t;

The $S_{0n}(c,t)$ are continuous functions of c for c>0;

The $S_{0n}(c,t)$ can be extended to be entire functions of the complex variable t;

The $S_{0n}(c,t)$ are orthogonal in (−1, 1) and are complete in $L_1^2$;

$S_{0n}(c,t)$ have exactly n zeros in (−1, 1);

$S_{0n}(c,t)$ reduce to $P_n(t)$ uniformly in [−1, 1] as c→0; and,

The $S_{0n}(c,t)$ are even or odd according to whether n is even or odd.

(As an aside, $S_{0n}(c,0)=P_n(0)$ where $P_n(t)$ is the nth Legendre polynomial).

Slepian shows the correspondence between $S_{0n}(c,t)$ and $\psi_n(t)$ using the radial prolate spheroidal functions which are proportional (for each n) to the angular prolate spheroidal functions according to:

$$R_{0n}^{(1)}(c,t)=k_n(c)S_{0n}(c,t) \tag{14}$$

which are then found to determine the Time-Limiting/Band-Limiting eigenvalues $$\lambda_n(c) = \frac{2c}{\pi}[R_{0n}^{(1)}(c, 1)]^2,\ n = 0, 1, 2, \ldots\ . \tag{15}$$

The correspondence between $S_{0n}(c,t)$ and $\psi_n(t)$ is given by:

$$\psi_n(c, t) = \frac{\sqrt{\lambda_n(c)}}{\sqrt{\int_{-1}^{1}[S_{0n}(c, t)]^2\,dt}} S_{0n}(c, 2t/T), \tag{16}$$

the above formula obtained combining two of Slepian's formulas together, and providing further calculation:

$$\psi_n(c, t) = \frac{R_{0n}^{(1)}(c, 1)\sqrt{\frac{2c}{\pi}}}{\sqrt{\int_{-1}^{1}[S_{0n}(c, t)]^2\,dt}} S_{0n}(c, 2t/T) \tag{18}$$

or $$\psi_n(c, t) = \frac{k_n(c)S_{0n}(c, t)\sqrt{\frac{2c}{\pi}}}{\sqrt{\int_{-1}^{1}[S_{0n}(c, t)]^2\,dt}} S_{0n}(c, 2t/T). \tag{19}$$

Additionally, orthogonally was shown [3] to be true over two intervals in the time-domain:

$$\int_{-\frac{T}{2}}^{\frac{T}{2}} \psi_i(t)\psi_j(t)\,dt = \begin{cases} 0, & i \neq j \\ \lambda_i, & i = j \end{cases}\ i, j = 0, 1, 2, \ldots\ . \tag{20}$$

$$\int_{-\infty}^{\infty} \psi_i(t)\psi_j(t)\,dt = \begin{cases} 0, & i \neq j \\ 1 & i = j \end{cases}\ i, j = 0, 1, 2, \ldots\ . \tag{21}$$

Orthogonality over two intervals, sometimes called "double orthogonality" or "dual orthogonality," is a very special property [29-31] of an eigensystem; such eigenfunctions and the eigensystem itself are said to be "doubly orthogonal."

Of importance to the intended applications for the low-pass kernel formulation of the Slepian mathematics [3-5] was that the eigenvalues were real and were not shared by more than one eigenfunction (i.e., the eigenvalues are not repeated, a condition also called "non-degenerate" accordingly a "degenerate" eigensystem has "repeated eigenvalues.")

Most of the properties of $\psi_n(c,t)$ and $S_{0n}(c,t)$ will be of considerable value to the development to follow.

Figure 5A:
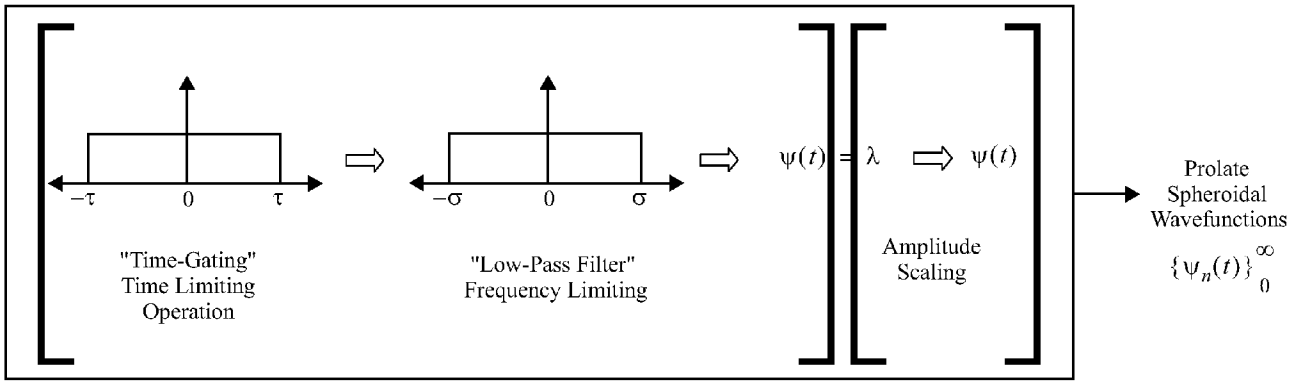
FIG. 5*a* shows a representation of the low-pass kernel case in a manner similar to that of FIGS. 1*a* and 1*b*.
Figure 5B:
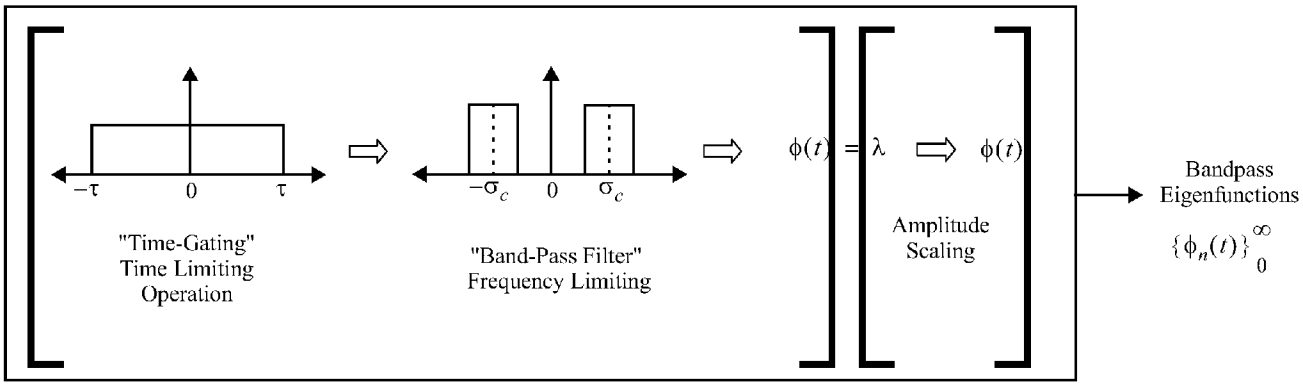
FIG. 5*b* shows a corresponding representation of the band-pass kernel case in a manner similar to that of FIG. 5*a*.

5. The Bandpass Variant and its Relation to Auditory Eigenfunction Hilbert Space Model A variant of Slepian's PSWF mathematics (which in fact Slepian and Pollak comment on at the end of the initial 1961 paper [3]) replaces the low-pass kernel with a band-pass kernel. The band-pass kernel leaves out low frequencies, passing only frequencies of a particular contiguous range. FIG. 5*a* shows a representation of the low-pass kernel case in a manner similar to that of FIGS. 1*a* and 1*b*. FIG. 5*b* shows a corresponding representation of the band-pass kernel case in a manner similar to that of FIG. 5*a*.

Referring to the {"a", "b", "c"} empirical attributes of human hearing and the {"1", "2", "3"} Slepian PSWF mathematics, replacing the low-pass kernel with a band-pass kernel amounts to replacing condition "1" in Slepian's PSWF mathematics with empirical hearing attribute "a." For the purposes of initially formulating the Hilbert space model, conditions "2" and "3" in Slepian's PSWF mathematics may be treated as effectively equivalent to empirical hearing attributes "b" and "c." Thus formulating a band-pass kernel variant of Slepian's PSWF mathematics suggests the possibility of creating and exploring a Hilbert-space of eigenfunctions modeling auditory perception. This is shown in FIG. 6*a*, which may be compared to FIG. 1*a*.

Figure 6A:
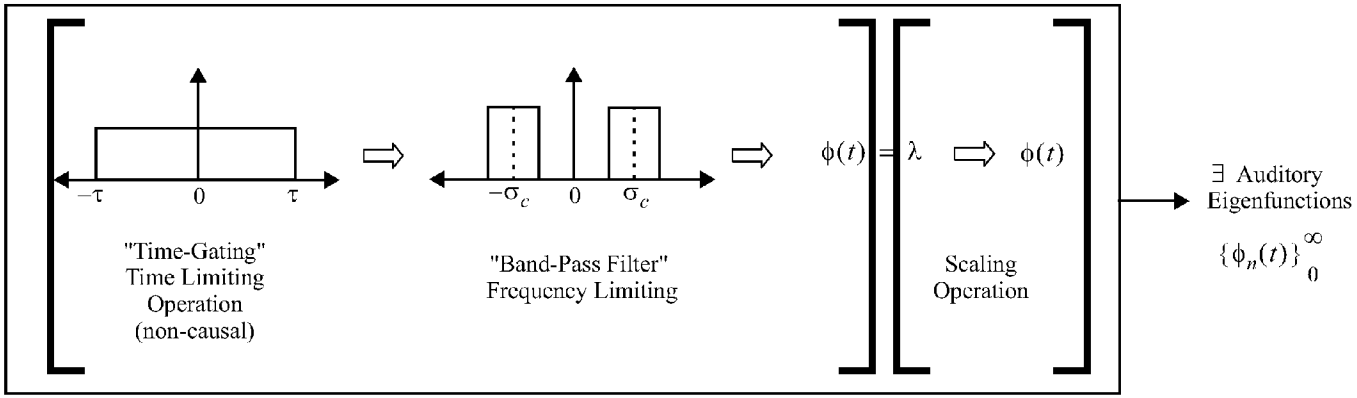
FIG. 6*a* shows a corresponding representation of the band-pass kernel case in a first (non causal) manner relating to the concept of a Hilbert space model of auditory eigenfunctions.
Figure 6B:
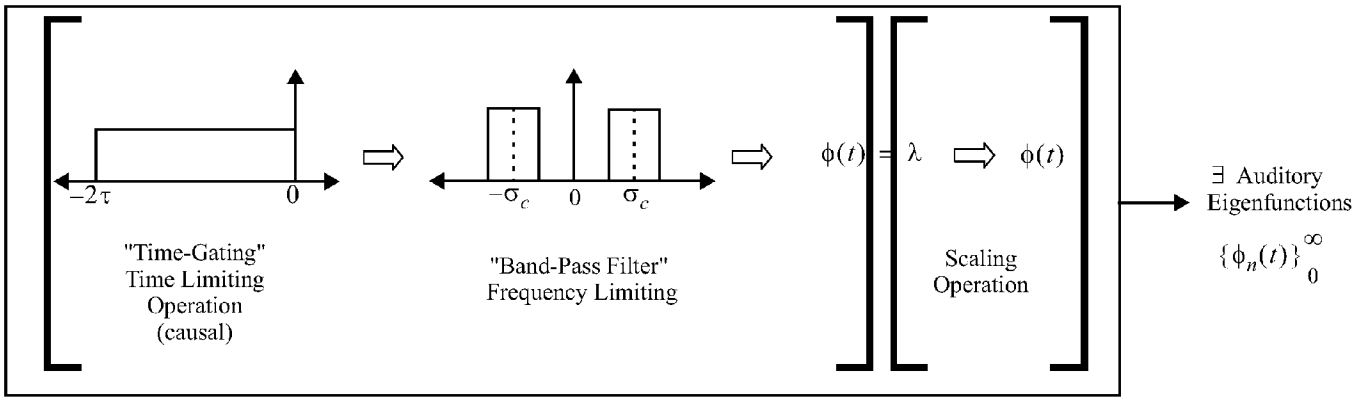
FIG. 6*b* shows a causal variation of FIG. 6*a* wherein the time-limiting operation has been shifted so as to depend only on events in past time up to the present (time 0).
Figure 7A:
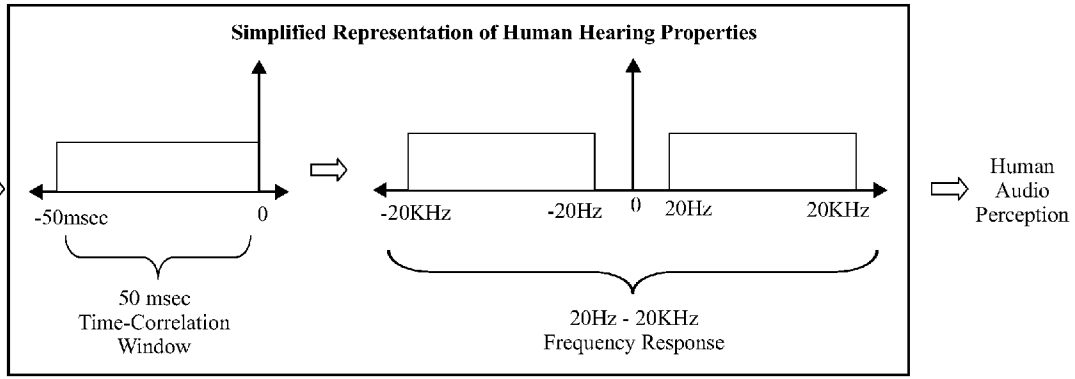
FIG. 7*a* shows a resulting view bridging the empirical model represented in FIG. 1*a* with a causal modification of the band-pass variant of the Slepian PSWF mathematics represented in FIG. 6*b*.
Figure 7B:
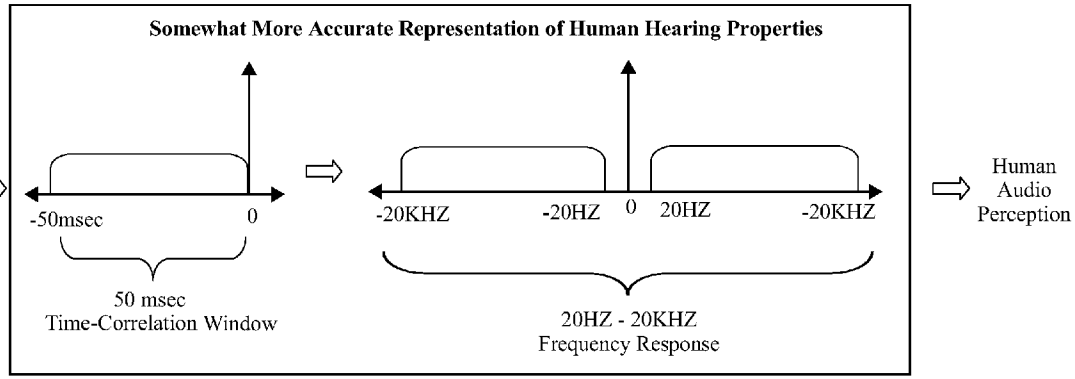
FIG. 7*b* develops the model of FIG. 7*a* further by incorporating the smoothed transition regions represented in FIG. 1*b*.

It is noted that the Time-Limiting operation in the arrangement of FIG. 6*a* is non-causal, i.e., it depends on the past (negative time), present (time 0), and future (positive time). FIG. 6*b* shows a causal variation of FIG. 6*a* wherein the Time-Limiting operation has been shifted so as to depend only on events in past time up to the present (time 0). FIG. 7*a* shows a resulting view bridging the empirical model represented in FIG. 1*a* with a causal modification of the band-pass variant of the Slepian PSWF mathematics represented in FIG. 6*b*. FIG. 7*b* develops this further by incorporating the smoothed transition regions represented in FIG. 1*b*.

Attention is now directed to mathematical representations of unit gate functions as used in the Band-Limiting operation (and relevant to the Time-Limiting operation). A unit gate function (taking on the values of 1 on an interval and 0 outside the interval) can be composed from generalized functions in various ways, for example various linear combinations or products of generalized functions, including those involving a negative dependent variable. Here representations as the difference between two "unit step functions" and as the difference between two "sign functions" (both with positive unscaled dependent variable) are provided for illustration and associated calculations.

Figure 8A:
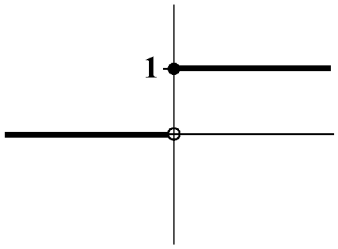
FIG. 8*a* depicts a unit step function.
Figure 8B:
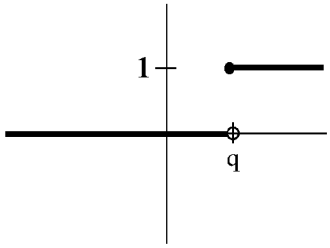
FIGS. 8*b* and 8*c* depict shifted unit step functions.
Figure 8C:
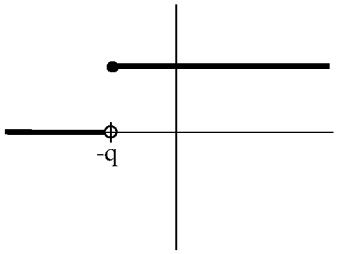
Figure 8D:
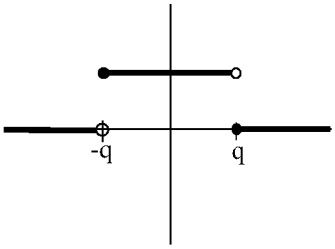
FIG. 8*d* depicts a unit gate function as constructed from a linear combination of two unit step functions.

FIG. 8*a* illustrates a unit step function, notated as UnitStep [x] and traditionally defined as a function taking on the value of 0 when x is negative and 1 when x is non-negative if the dependent variable x is offset by a value q>0 to x−q or x+q, the unit step function UnitStep[x] is, respectively, shifted to the right (as shown in FIG. 8*b*) or left (as shown in FIG. 8*c*). When a unit function shifted to the right (notated UnitStep [x−a]) is subtracted from a unit function shifted to the left (notated UnitStep[x+a]), the resulting function is equivalent to a gate function, as illustrated in FIG. 8*d*.

Figure 9A:
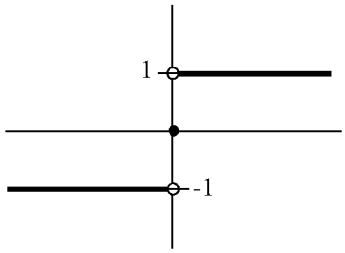
FIG. 9*a* depicts a sign function.
Figure 9B:
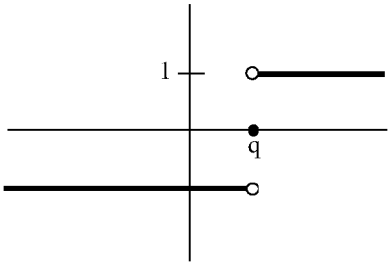
FIGS. 9*b* and 9*c* depict shifted sign functions.
Figure 9C:
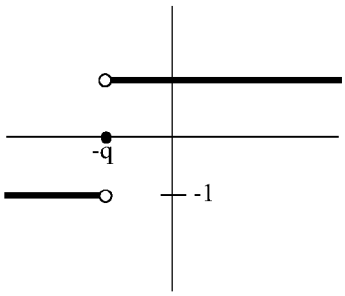
Figure 9D:
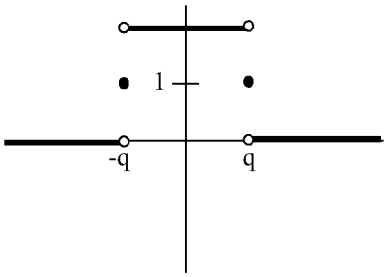
FIG. 9*d* depicts a unit gate function as constructed from a linear combination of two sign functions.

As mentioned earlier, a gate function can also be represented by a linear combination of "sign" functions. FIG. 9*a* illustrates a sign function, notated Sign[x], traditionally defined as a function taking on the value of −1 when x is negative, zero when x=0, and +1 when x is positive. If the dependent variable x is offset by a value q>0 to x−a or x+a, the sign function Sign[x] is, respectively, shifted to the right (as shown in FIG. 9*b*) or left (as shown in FIG. 9*c*). When a sign function shifted to the right (notated Sign[x−a]) is subtracted from a sign function shifted to the left (notated Sign[x+a]), the resulting function is similar to a gate function as illustrated in FIG. 9*d*. However, unlike the case of gate function composed of two unit step functions, the resulting function has to be normalized by ½ in order to obtain a representation for the unit gate function.

Figure 10A:
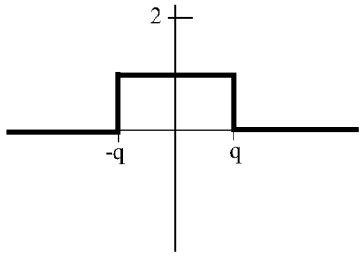
FIG. 10*a* depicts an informal view of a unit gate function wherein details of discontinuities are figuratively generalized by the depicted vertical lines.

These two representations for the gate function differ slightly in the handling of discontinuities and invoke some issues with symbolic expression handling in computer applications such as Mathematica™, MatLAB™, etc. For the analytical calculations here, the discontinuities are a set with zero measure and are thus of no consequence. Henceforth the unit gate function will be depicted as in FIG. 10*a* and details of discontinuities will be figuratively generalized (and mathematically obfuscated) by the depicted vertical lines. Attention is now directed to constructions of bandpass kernel from a linear combination of two gate functions.

Subtractive Unshifted Representation: By subtracting a narrower unshifted unit gate function from a wider unshifted unit gate function, a unit 'bandpass gate function' is obtained. For example, when representing each unit gate function by the difference of two sign functions (as described above), the unit 'bandpass gate function' can be represented as:

$$\frac{1}{2}[(\mathrm{Sign}[x+\beta]-\mathrm{Sign}[x-\beta])-(\mathrm{Sign}[x+\alpha]-\mathrm{Sign}[x-\alpha])]$$

Figure 10B:
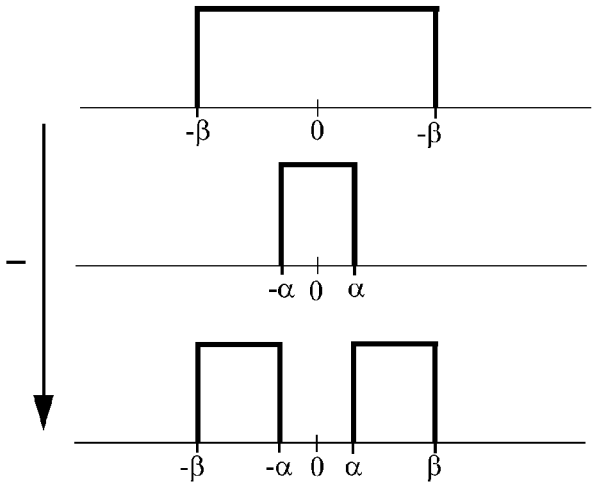
FIG. 10*b* depicts a subtractive representation of a unit 'bandpass gate function.'

This subtractive unshifted representation of unit 'bandpass gate function' is depicted in FIG. 10*b*.

Additive Shifted Representation: By adding a left-shifted unit gate function to a right-shifted unit gate function, a unit 'bandpass gate function' is obtained. For example, when representing each unit gate function by the difference of two sign functions (as described above), the unit 'bandpass gate function' can be represented as:

$$\frac{1}{2}[\mathrm{Sign}[w+(x+d)]+\mathrm{Sign}[w-(x+d)]+\frac{1}{2}[\mathrm{Sign}[w+(x-d)]+\mathrm{Sign}[w-(x-d)]$$

Figure 10C:
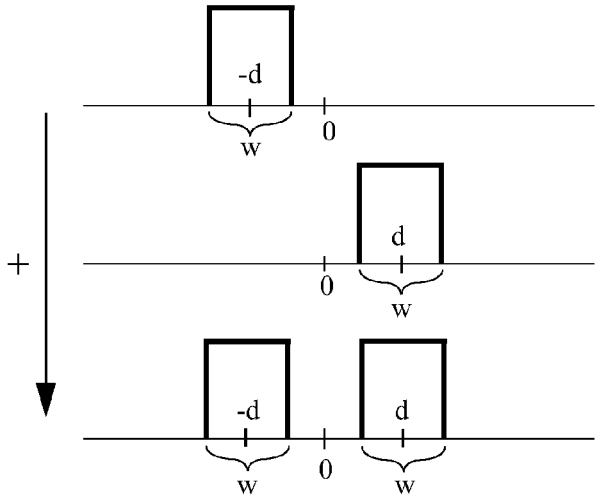
FIG. 10*c* depicts an additive representation of a unit 'band-pass gate function.'

This additive shifted representation of unit 'bandpass gate function' is depicted in FIG. 10*c*.

By organized equating of variables these can be shown to be equivalent with certain natural relations among α, β, w, and d. Further, it can be shown that the additive shifted representation leads to the cosine modulation form described in conjunction with FIGS. 11*a* and 11*b* (described below) as used by Slepian and Pollack [3] as well as Morrison [12] while the subtractive unshifted version leads to unshifted since functions which can be related to the cosine modulated sinc function through use of the trigonometric identity:

$$\sin\alpha\cos\beta=\frac{1}{2}\sin(\alpha+\beta)+\frac{1}{2}\sin(\alpha-\beta)$$

6. Early Analysis of the Bandpass Variant—Work of Slepian, Pollak and Morrison

Figure 11A:
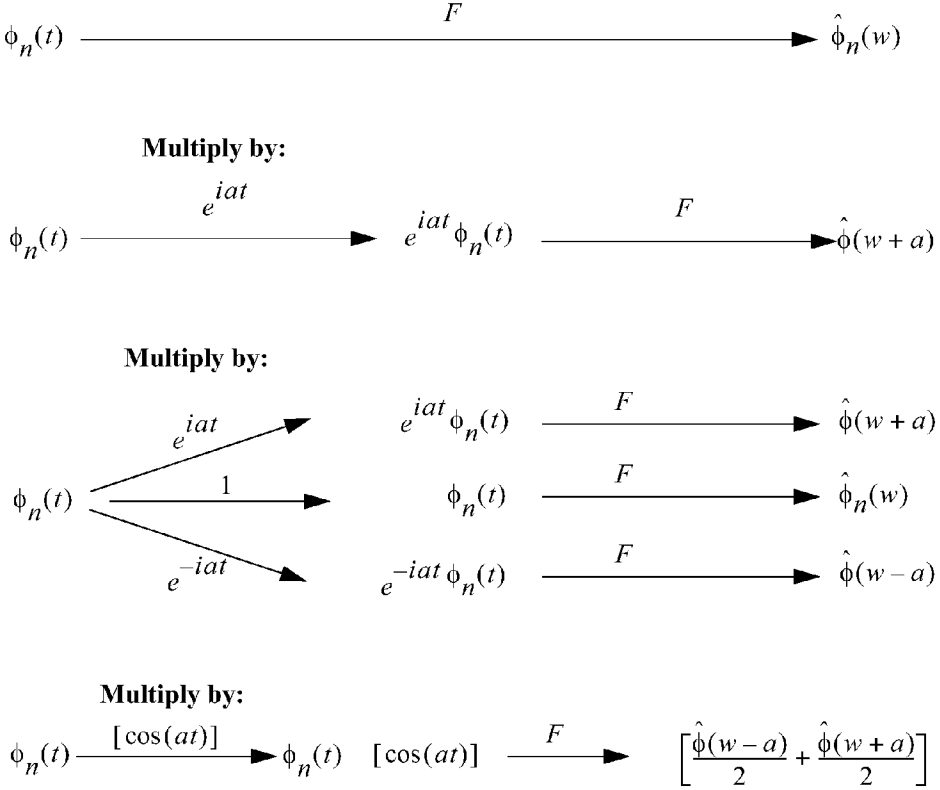
FIG. 11*a* depicts a cosine modulation operation on the lowpass kernel to transform it into a bandpass kernel.
Figure 11B:
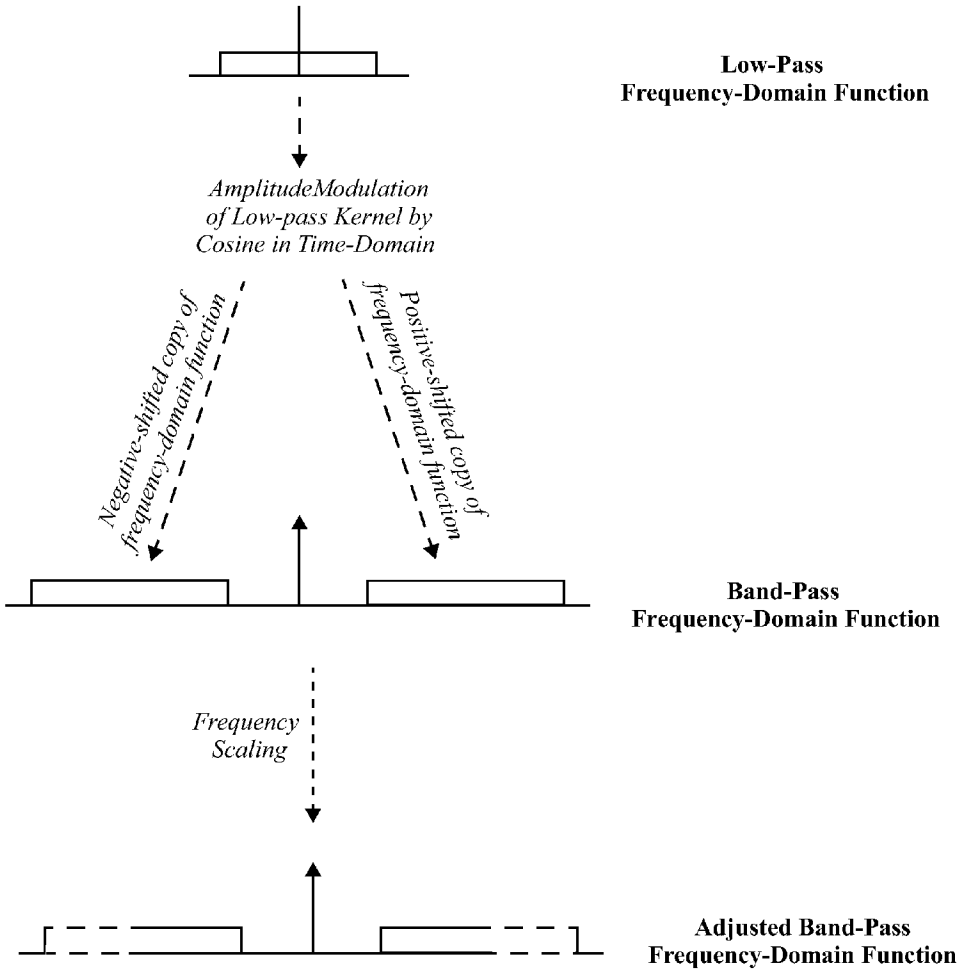
FIG. 11*b* graphically depicts operations on the lowpass kernel to transform it into a frequency-scaled bandpass kernel.

The lowpass kernel can be transformed into a bandpass kernel by cosine modulation $$\cos\theta = \frac{e^{i\theta} + e^{-i\theta}}{2}$$

as shown in FIG. 11*a*. FIG. 11*b* graphically depicts operations on the lowpass kernel to transform it into a frequency-scaled bandpass kernel—each complex exponential invokes a shift operation on the gate function:

$$\frac{1}{2}e^{-i\theta t}$$

shifts the function to the right in direction by θ units $$\frac{1}{2}e^{i\theta t}$$

shifts the function to the left in direction by θ units

This corresponds to the additive shifted representation of the unit gate function described above. The resulting kernel, using the notation of Morrison [12], is:

$$\frac{\sin[bt]}{bt}\cos[at]$$

and the corresponding convolutional integral equation (in a form anticipating eigensystem solutions) is $$\lambda_i u_i(t) = \int_{-\frac{T}{2}}^{\frac{T}{2}} \frac{\sin[b(t-s)]}{b(t-s)}\cos[a(t-s)]u_i(s)ds, \quad i = 0, 1, 2, \ldots .$$

Slepian and Pollak's sparse passing remarks pertaining to the band-pass variant, however, had to do with the existence of certain types of differential equations that would be related and with the fact that the eigensystem would have repeated eigenvalues (degenerate). Morrison shortly thereafter developed this direction further in a short series of subsequent papers [11-14; also see 15]. The bandpass variant has effectively not been studied since, and the work that has been done on it is not of the type that can be used directly for creating and exploring a Hilbert-space of eigenfunctions modeling auditory perception.

The little work available on the bandpass variant [3,11-14; also 15] is largely concerned about degeneracy of the eigensystem in interplay with fourth order differential operators.

Under the assumptions in some of this work (for example, as in [3,12] degeneracy implies one eigenfunction can be the derivative of another eigenfunction, both sharing the same eigenvalue. The few results that are available for the (step-boundary transition) bandpass kernel case describe ([3] page 43, last three sentences, [12] page 13 last paragraph though paragraph completion atop page 14):

- The existence of bandpass variant eigensystems with repeated eigenvalues [12,14] wherein time-derivatives of a given eigenfunction are also seen to be an eigenfunction sharing the same eigenvalue with the given eigenfunction. (In analogies with sines and cosines, may give rise to quadrature structures (as for PSWF-type mathematics) [20] and/or Jordan chains [40]);
- Although the $2^{nd}$-order linear differential operator of the classical PSWF differential equation commutes with the lowpass kernel integral operator, there is in the general case no $2^{nd}$-order or $4^{th}$-order self-adjoint linear differential operator with polynomial coefficients (i.e., a comparable $2^{nd}$-order or $4^{th}$-order linear differential operator) that commutes with the bandpass kernel integral operator;
- However, a $4^{th}$-order self-adjoint linear differential operator does exist under these conditions ([12] page 13 last paragraph though paragraph completion atop page 14):
  - i. The eigenfunctions are either even or odd functions;
  - ii. The eigenfunctions vanish outside the Time-Limiting interval (for example, outside the interval {−T/2, +T/2} in the Slepian/Pollack PSFW formulation [3] or outside the interval {−1, +1} in the Morrison formulation [12]; this imposes the degeneracy condition.
- Morrison provides further work, including a proposed numerical construction, but then in this [12] and other papers (such as [14]) turns attention to the limiting case where the scale term "b" of the sinc function in his Eq. (1.5). approaches zero (which effectively replaces the "sinc" function kernel with a cosine function kernel).
- The bandpass variant eigenfunctions inherit the double orthogonality property ([3], page 63, third-to-last sentence].

7. Relating Early Bandpass Kernel Results to Hilbert Space Auditory Eigenfunction Model As far as creating a Hilbert-space of eigenfunctions modeling auditory perception, one would be concerned with the eigensystem of the underlying integral equation (actually, in particular, a convolution equation) and not have concern regarding any differential equations that could be demonstrated to share them. Setting aside any differential equation identification concern, it is not clear that degeneracy is always required and that degeneracy would always involve eigenfunctions such that one is the derivative of another. However, even if either or both of these were indeed required, this might be fine. After all, the solutions to a second-order linear oscillator differential equation (or integral equation equivalent) involve sines and cosines; these would be able to share the same eigenvalue and in fact sine and cosine are (with a multiplicative constant) derivatives of one another, and sines and cosines have their role in hearing models. Although one would not expect the Hilbert-space of eigenfunctions modeling auditory perception to comprise simple sines and cosines, such requirements (should they emerge) are not discomforting.

FIG. 12*a* depicts a table comparing basis function arrangements associated with Fourier Series, Hermite function series, Prolate Spheriodal Wave Function series, and the invention's auditory eigenfunction series.

- The Fourier series basis functions have many appealing attributes which have lead to the wide applicability of Fourier analysis, Fourier series, Fourier transforms, and Laplace transforms in electronics, audio, mechanical engineering, and broad ranges of engineering and science. This includes the fact that the basis functions (either as complex exponentials or as trigonometric functions) are the natural oscillatory modes of linear differential equations and linear electronic circuits (which obey linear differential equations). These basis functions also provide a natural framework for frequency-dependent audio operations and properties such as tone controls, equalization, frequency responses, room resonances, etc.

The Hermite Function basis functions are more obscure but have important properties relating them to the Fourier transform [34] stemming from the fact that they are eigenfunctions of the (infinite) continuous Fourier transform operator. The Hermite Function basis functions were also used to define the fractional Fourier transform by Naimas [51] and later but independently by the inventor to identify the role of the fractional Fourier transform in geometric optics of lenses [52] approximately five years before this optics role was independently discovered by others ([53], page 386); the fractional Fourier transform is of note as it relates to joint time-frequency spaces and analysis, the Wigner distribution [53], and, as shown by the inventor in other work, incorporates the Bargmann transform of coherent states (also important in joint time-frequency analysis [41]) as a special case via a change of variables. (The Hermite functions of course also play an important independent role as basis functions in quantum theory due to their eigenfunction roles with respect to the Schrödinger equation, harmonic oscillator, Hermite semigroup, etc.)

The PSWF basis functions are historically even more obscure but have gained considerable attention as a result of the work of Slepian, Pollack, and Landau [3-5], many of their important properties stemming from the fact that they are eigenfunctions of the finite continuous Fourier transform operator [3]. (The PSWF historically also play an important independent role as basis functions in electrodynamics and mechanics due to their eigenfunction roles with respect to the classical prolate spheriodial differential equation).

The auditory eigenfunctions basis functions of the present invention are thought to be an even more recent development. Among their advocated attributes are that they are the eigenfunctions of the "auditory perception" operation and as such serve as the natural modes of auditory perception.

Also depicted in the chart is the likely role of degeneracy for the auditory eigenfunctions as suggested by the bandpass kernel work cited above [11-15]. This is compared with the known repeated eigenvalues of the Hermite functions (only four eigenvalues) [34] when diagonalizing the infinite continuous Fourier transform operator and the fact that derivatives of Fourier series basis functions are again Fourier series basis functions. Thus the auditory eigenfunctions (whose properties can vary somewhat responsive to incorporating the transitional aspects depicted in FIG. 1*b*) likely share attributes of the Fourier series basis functions typically associated with sound and the Hermite series basis functions associated with joint time-frequency spaces and analysis. Not shown in the chart is the likely inheritance of double orthogonality which, as discussed, offers possible roles in models of critical-band attributes of human hearing.

8. Numerical Calculation of Auditory Eigenfunctions

Figure 12B:
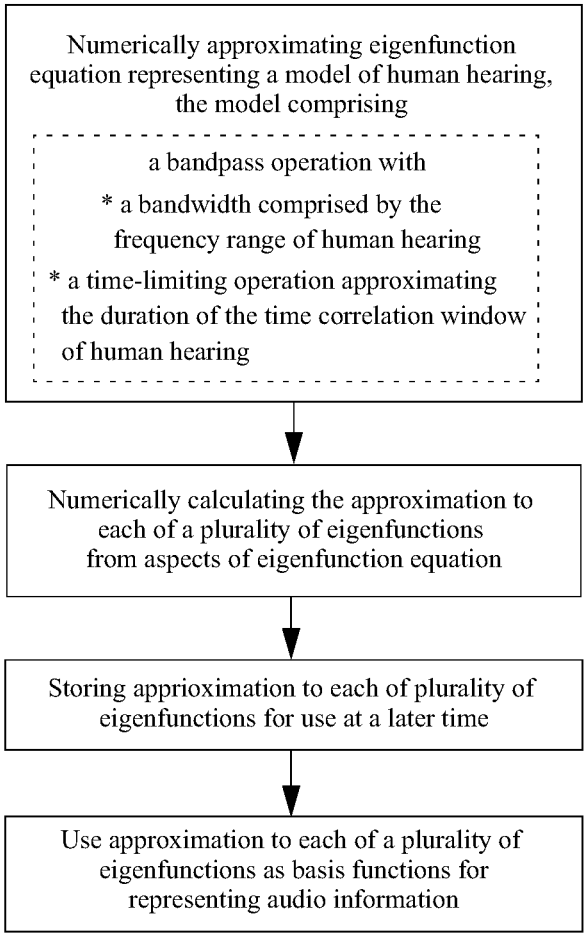
FIG. 12*b* depicts the steps of numerically approximating, on a computer or mathematical processing device, an eigenfunction equation representing a model of human hearing, the model comprising a bandpass operation with a bandwidth comprised by the frequency range of human hearing and a time-limiting operation approximating the duration of the time correlation window of human hearing.

Based on the above, the invention provides for numerically approximating, on a computer or mathematical processing device, an eigenfunction equation representing a model of human hearing, the model comprising a bandpass operation with a bandwidth comprised by the frequency range of human hearing and a time-limiting operation approximating the duration of the time correlation window of human hearing. In an embodiment the invention numerically calculates an approximation to each of a plurality of eigenfunctions from at least aspects of the eigenfunction equation. In an embodiment the invention stores said approximation to each of a plurality of eigenfunctions for use at a later time. FIG. 12*b* depicts the above Below an example for numerically calculating, on a computer or mathematical processing device, an approximation to each of a plurality of eigenfunctions to be used as an auditory eigenfunction. Mathematical software programs such as Mathematica™ [21] and MATLAB™ and associated techniques that can be custom coded (for example as in [54]) can be used. Slepian's own 1968 numerical techniques [25] as well as more modern methods (such as adaptations of the methods in [26]) can be used.

In an embodiment the invention provides for the eigenfunction equation representing a model of human hearing to be an adaptation of Slepian's bandpass-kernel variant of the integral equation satisfied by angular prolate spheroidal wavefunctions.

In an embodiment the invention provides for the approximation to each of a plurality of eigenfunctions to be numerically calculated following the adaptation of the Morrison algorithm described in Section 8.

8.1 Numerical Calculation of Eigenfunctions for Bandpass Kernel Case

Figure 13:
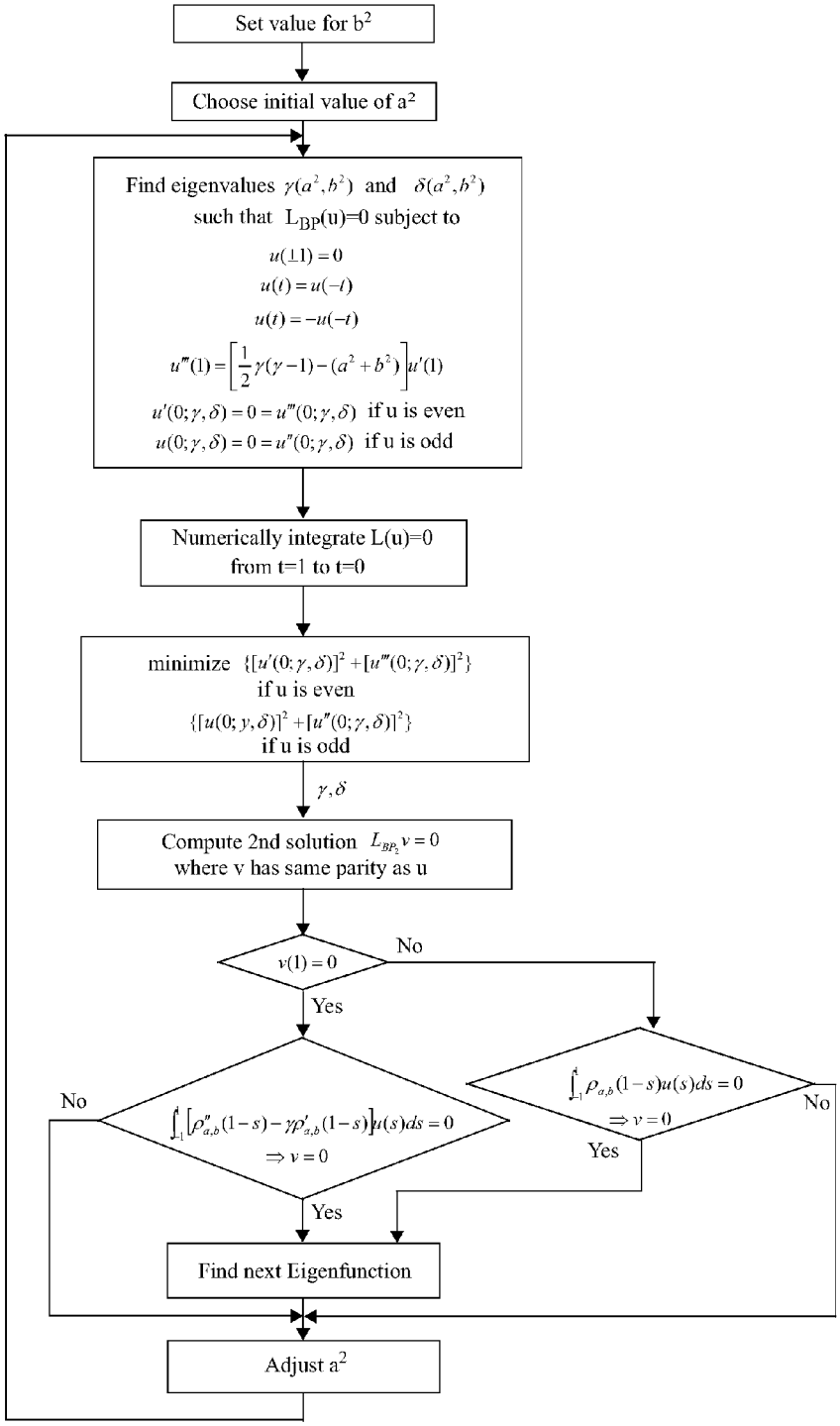
FIG. 13 depicts a flow chart for an adapted version of the numerical algorithm proposed by Morrison [12].

In an embodiment the invention provides for the eigenfunction equation representing a model of human hearing to be an adaptation of Slepian's bandpass-kernel variant of the integral equation satisfied by angular prolate spheroidal wavefunctions, and further that the approximation to each of a plurality of eigenfunctions to be numerically calculated following the adaptation of the Morrison algorithm described below. FIG. 13 provides a flowchart of the exemplary adaptation of the Morrison algorithm. The equations used by Morrison in the paper [12] are provided to the left of the equation with the prefix "M."

Specifically, Morrison ([12], top page 18) describes "a straightforward, though lengthy, numerical procedure" through which eigenfunctions of the integral equation K[u(t)]=λu(t) with (M 4.5)

$$K[u(t)] = \int_{-1}^{1} \rho_{a,b}(t-s)u(s)ds \text{ and} \tag{24}$$

(M 1.5)

$$\rho_{a,b}(t) = \frac{\sin bt}{bt}\cos at;\ a > b > 0 \tag{25}$$

may be numerically approximated in the case of degeneracy under the vanishing conditions u(±1)=0.

The procedure starts with a value of $b^2$ that is given. A value is then chosen for $a^2$. The next step is to find eigenvalues $\gamma(a^2,b^2)$ and $\delta(a^2,b^2)$, such that Lu=0, where L[u(t)] is given by Eq. (M 3.15), and u is subject to Eqs. (3.11), (3.13), (3.14), (4.1), and (4.2.even)/(4.2.odd).

(M 3.11)

$$u(\pm 1) = 0 \tag{26}$$

(M 3.13)

-continued $$u(t) = u(-t), \text{ or } u(t) = -u(-t) \tag{27}$$

(M 3.14)

$$u''(1) = \gamma u'(1) \tag{30}$$

(M 4.1)

$$u'''(1) = \left[\frac{1}{2}\gamma(\gamma - 1) - (a^2 + b^2)\right]u'(1) \tag{31}$$

(M 4.2.even)

$$u'(0; \gamma, \delta) = 0 = u'''(0; \gamma, \delta), \text{ if } u \text{ is even} \tag{32}$$

(M 4.2.odd)

$$u(0; \gamma, \delta) = 0 = u''(0; \gamma, \delta), \text{ if } u \text{ is odd} \tag{33}$$

The next step is to numerically integrate $L_{BP_1}u=0$ from t=1 to t=0, where
(M 4.3)

(M 4.3)

$$L_{BP_1}[u(t)] = \frac{d^2}{dt^2}\left[(1-t^2)\frac{d^2u}{dt^2}\right] + \frac{d}{dt}\left\{[\gamma + (a^2+b^2)(1-t^2)]\frac{du}{dt}\right\} + [\delta - (a^2-b^2)^2t^2]u. \tag{34}$$

The next step is to numerically minimize (to zero) $\{[u'(0;\gamma,\delta)]^2+[u'''(0;\gamma,\delta)]^2\}$, or $\{[u(0;\gamma,\delta)]^2+[u''(0;\gamma,\delta)]^2\}$, accordingly as u is to be even or odd, as functions of γ and δ. (Note there is a typo in this portion of Morrison's paper wherein the character "y" is printed rather than the character "γ;" this was pointed out by Seung E. Lim)

Having determined γ and δ, the next step is to straightforwardly compute the other solution ν from $L_{BP_2}v=0$ for (M 3.15)

$$L_{BP_2}[v(t)] = v\frac{d}{dt}[(1-t^2)]\frac{d^2u}{dt^2} - u\frac{d}{dt}\left[(1-t^2)\frac{d^2v}{dt^2}\right] + (1-t^2)\left(\frac{du}{dt}\frac{d^2v}{dt^2} - \frac{dv}{dt}\frac{d^2u}{dt^2}\right) + 2[\gamma + (a^2+b^2)(1-t^2)]\left(v\frac{du}{dt} - u\frac{dv}{dt}\right) \tag{35}$$

wherein ν has the same parity as u.

Then, as the next step, tests are made for the condition of Eq. (4.7) or Eq. (4.8), holds, which of these being determined by the value of ν(1):

(M 4.7)

$$v(1) \neq 0 \text{ and } \int_{-1}^{1}\rho_{a,b}(1-s)u(s)ds = 0 \Rightarrow v = 0 \tag{36}$$

(M 4.8)

$$v(1) = 0 \text{ and } \int_{1}^{-1}[\rho''_{a,b}(1-s) - \gamma\rho'_{a,b}(1-s)]u(s)ds = 0 \Rightarrow v = 0 \tag{37}$$

If neither condition is met, the value of $a^2$ must be accordingly adjusted to seek convergence, and the above procedure repeated, until the condition of Eq. (4.7) or Eq. (4.8), holds (which of these being determined by the value of ν(1)).

8.2. Alternative Construction Employing Khare Construction

As an alternative to the approach constructed thus far, Khare [38] provides a set of functions described as 'bandpass analogues of prolate spheroidal wave functions,' henceforth referred to by Khare's acronym "BPSF:"

$$S_m(x) = \sin\left[2B_0\left(x - \frac{m}{4B_0}\right)\right]\cos\left[2\pi f\left(x - \frac{m}{4B_0}\right)\right]$$

Khare shows these provide many aspects ([38], section 4) that while structured for other uses can be adapted for employment in the auditory eigenfunction concept at least as an approximation. Khare provides computation results ([38], section 5) and develops these BPSF from a construction of the PSWFs using the Whittaker-Shannon sampling theorem.

Ideally in each case additional adaptations are made to address the gradual transition bands shown in FIG. 1*b*. Since Khare develops the BPSF from a construction of the PSWFs using the Whittaker-Shannon sampling theorem, the horizontal linkage through the Whittaker-Shannon sampling theorem is also depicted.

10. Expected Utility of an Auditory Eigenfunction Hilbert Space Model for Human Hearing As is clear to one familiar with eigensystems, the collection of eigenfunctions is the natural coordinate system within the space of all functions (here, signals) permitted to exist within the conditions defining the eigensystem. Additionally, to the extent the eigensystem imposes certain attributes on the resulting Hilbert space, the eigensystem effectively defines the aforementioned "rose colored glasses" through which the human experience of hearing is observed.

Human hearing is a very sophisticated system and auditory language is obviously entirely dependent on hearing. Tone-based frameworks of Ohm, Helmholtz, and Fourier imposed early domination on the understanding of human hearing despite the contemporary observations to the contrary by Seebeck's framing in terms time-limited stimulus [16]. More recently, the time/frequency localization properties of wavelets have moved in to displace portions of the long standing tone-based frameworks. In parallel, empirically-based models such as critical band theory and loudness/pitch tradeoffs have co-developed. A wide range of these and yet other models based on emergent knowledge in areas such as neural networks, biomechanics and nervous system processing have also emerged (for example, as surveyed in [2,17-19]. All these have their individual respective utility, but the Hilbert space model could provide new additional insight.

Figure 14:
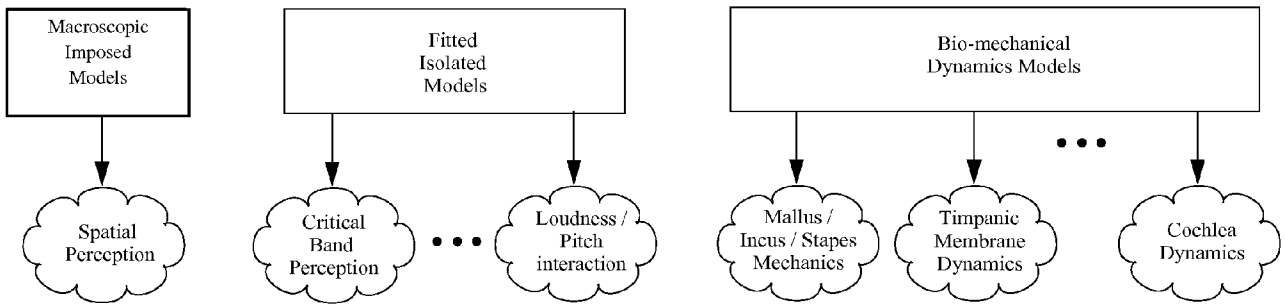
FIG. 14 provides a representation of macroscopically imposed models (such as frequency domain), fitted isolated models (such as critical band and loudness/pitch interdependence), and bottom-up biomechanical dynamics models.

FIG. 14 provides a representation of macroscopically imposed models (such as frequency domain), fitted isolated models (such as critical band and loudness/pitch interdependence), and bottom-up biomechanical dynamics models. Unlike these macroscopically imposed models, the Hilbert space model is built on three of the most fundamental empirical attributes of human hearing:

- the approximate 20 Hz-20 KHz frequency range of auditory perception [1];
- the approximate 50 msec temporal-correlation window of auditory perception (for example "time constant" in [2]);
- the approximate wide-range linearity (modulo post-summing logarithmic amplitude perception, nonlinearity explanations of beat frequencies, etc) when several signals are superimposed [1,2].

Figure 15:
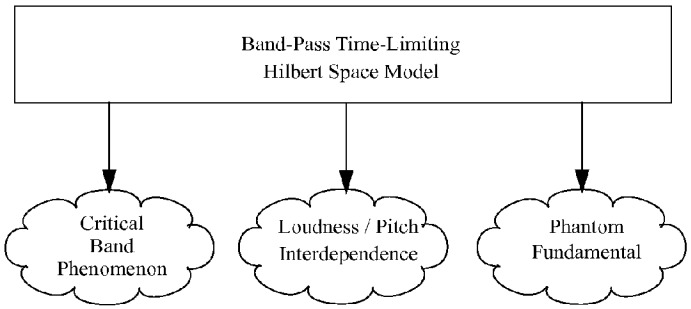
FIG. 15 shows how the Hilbert space model may be able to predict aspects of the models of FIG. 14.
Figure 16:
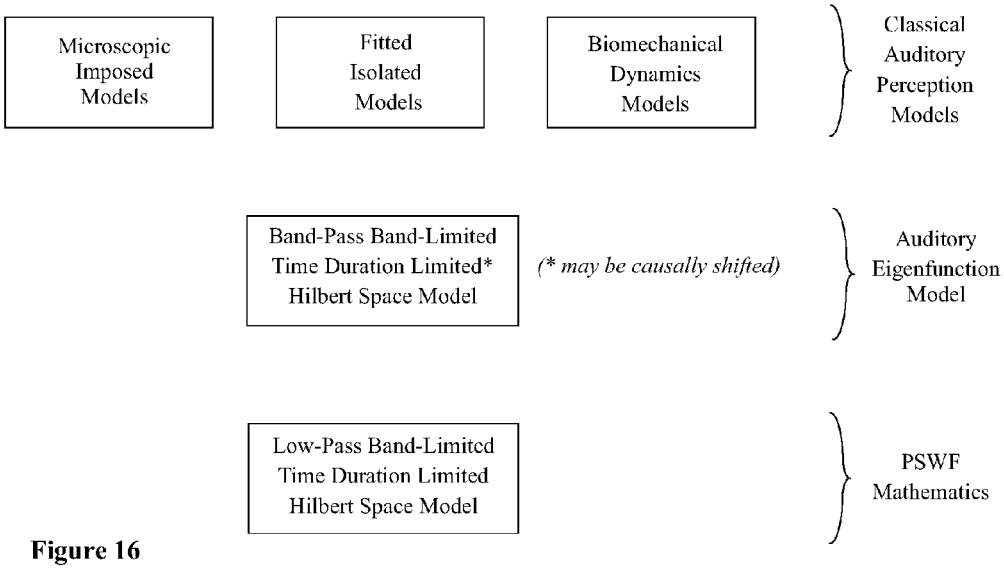
FIG. 16 depicts (column-wise) classifications among the classical auditory perception models of FIG. 14.

FIG. 15 shows how the Hilbert space model may be able to predict aspects of the models of FIG. 14. FIG. 16 depicts column-wise classifications among these classical auditory perception models wherein the auditory eigenfunction formulation and attempts to employ the Slepian lowpass kernel formulation) could be therein treated as examples of "fitted isolated models."

Figure 17:
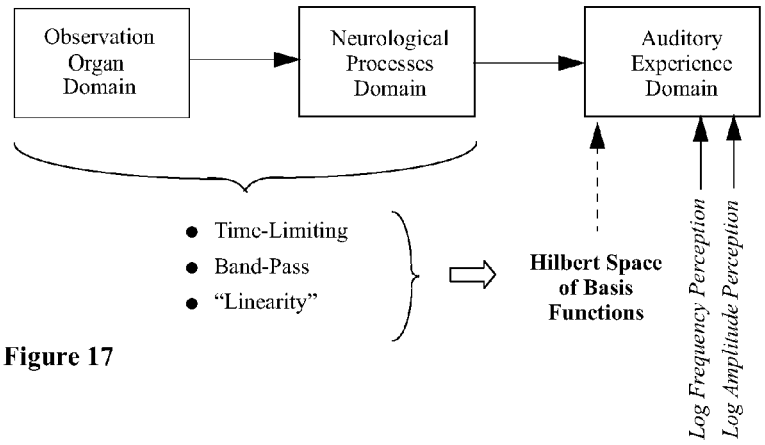
FIG. 17 shows an extended formulation of the Hilbert space model to other aspects of hearing, such as logarithmic senses of amplitude and pitch, and its role in representing observational, neurological process, and portions of auditory experience domains.

FIG. 17 shows an extended formulation of the Hilbert space model to other aspects of hearing, such as logarithmic senses of amplitude and pitch, and its role in representing observational, neurological process, and portions of auditory experience domains.

Further, as the Hilbert space model is, by its very nature, defined by the interplay of time limiting and band-pass phenomena, it is possible the model may provide important new information regarding the boundaries of temporal variation and perceived frequency (for example as may occur in rapidly spoken languages, tonal languages, vowel guide [6-8], "auditory roughness" [2], etc.), as well as empirical formulations (such as critical band theory, phantom fundamental, pitch/loudness curves, etc.) [1,2].

The model may be useful in understanding the information rate boundaries of languages, complex modulated animal auditory communications processes, language evolution, and other linguistic matters. Impacts in phonetics and linguistic areas may include:

Empirical phonetics (particularly in regard to tonal languages, vowel-glide [6-8], and rapidly-spoken languages); and Generative linguistics (relative optimality of language information rates, phoneme selection, etc.).

Together these form compelling reasons to at least take a systematic, psychoacoustics-aware, deep hard look at this band-pass time-limiting eigensystem mathematics, what it may say about the properties of hearing, and—to the extent the model comprises a natural coordinate system for human hearing—what applications it may have to linguistics, phonetics, audio processing, audio compression, and the like.

There are at least two ways the Hilbert space model can be applied to hearing:

a wideband version wherein the model encompasses the entire audio range (as described thus far); and an aggregated, multiple parallel narrow-band channel version wherein the model encompasses multiple instances of the Hilbert space, each corresponding to an effectively associated 'critical band'[2].

Figure 18:
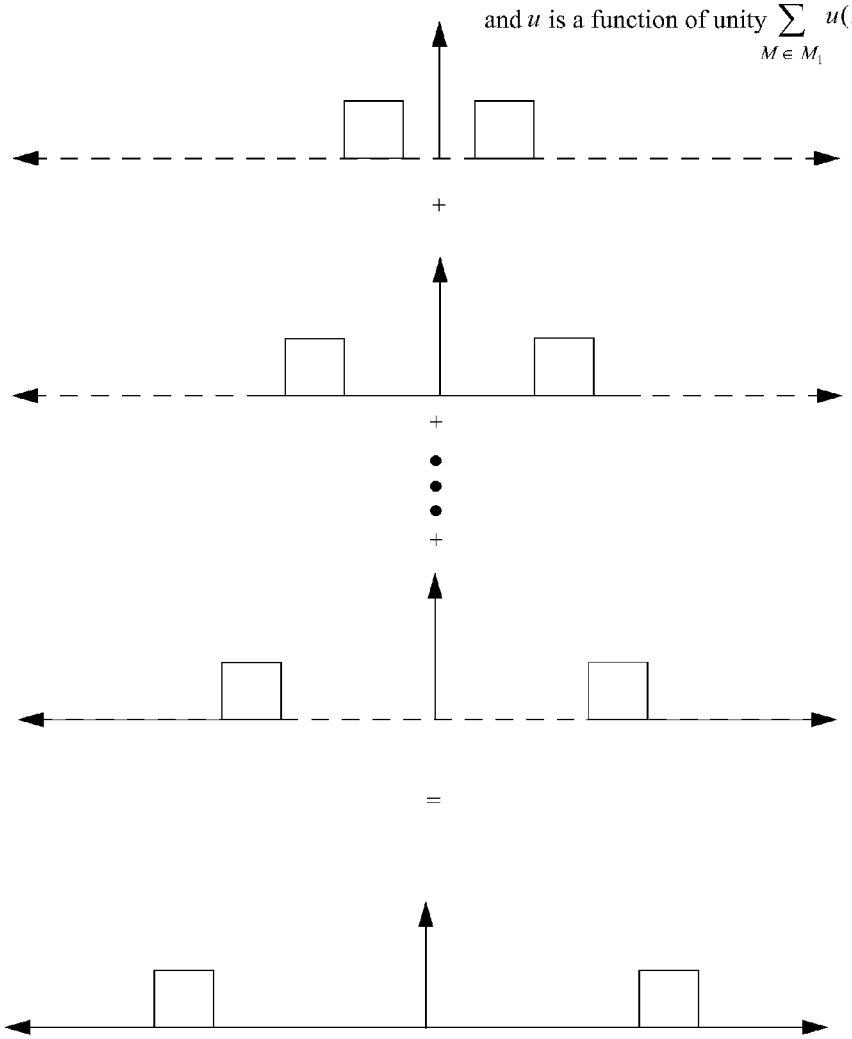
FIG. 18 depicts an aggregated multiple parallel narrow-band channel model comprising multiple instances of the Hilbert space, each corresponding to an effectively associated 'critical band.'

FIG. 18 depicts an aggregated multiple parallel narrow-band channel model comprising multiple instances of the Hilbert space, each corresponding to an effectively associated 'critical band.' In the latter, narrow-band partitions of the auditory frequency band represent each of these with a separate band-pass kernel. The full auditory frequency band is thus represented as an aggregation of these smaller narrow-band band-pass kernels.

The bandwidth of the kernels may be set to that of previously determined critical bands contributed by physicist Fletcher in the 1940's [28] and subsequently institutionalized in psychoacoustics. The partitions can be of either of two cases—one where the time correlation window is the same for each band, and variations of a separate case where the duration of time correlation window for each band-pass kernel is inversely proportional to the lowest and/or center frequency of each of the partitioned frequency bands. As pointed out earlier, Slepian indicated the solutions to the band-pass variant would inherit the relatively rare doubly-orthogonal property of PSWFs ([3], third-to-last sentence). The invention provides for an adaptation of doubly-orthogonal, for example employing the methods of [29], to be employed here, for example as a source of approximate results for a critical band model.

Figure 19:
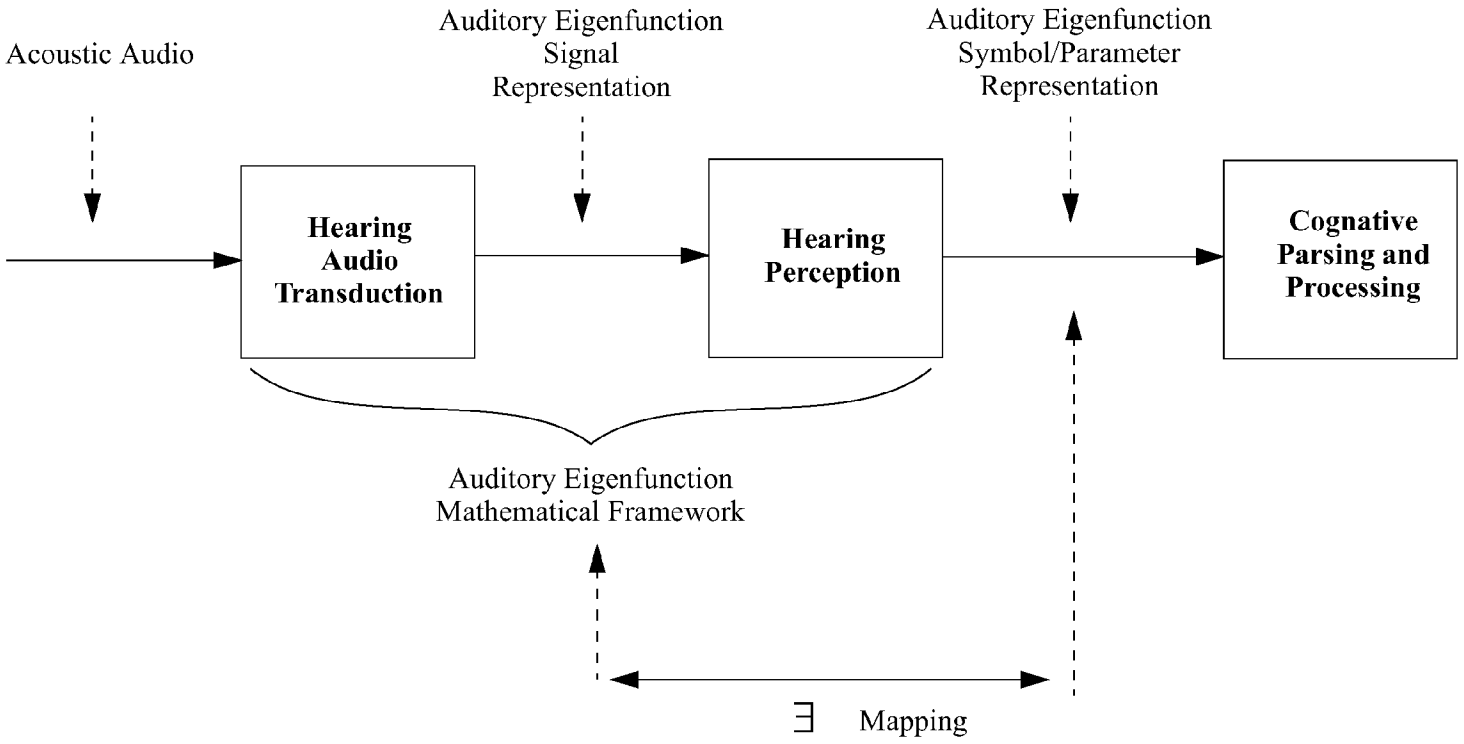
FIG. 19 depicts an auditory perception model somewhat adapted from the model of FIG. 17 wherein incoming acoustic audio is provided to a human hearing audio transduction and hearing perception operations whose outcomes and internal signal representations are modeled with an auditory eigenfunction Hilbert space model framework.

Finally, in regards to the expected utility of an auditory eigenfunction Hilbert space model for human hearing, FIG. 19 depicts an auditory perception model relating to speech somewhat adapted from the model of FIG. 17. In this model, incoming acoustic audio is provided to a human hearing audio transduction and hearing perception operations whose outcomes and internal signal representations are modeled with an auditory eigenfunction Hilbert space model framework. The model results in an auditory eigenfunction representation of the perceived incoming acoustic audio. (Later, in the context of audio encoding with auditory eigenfunction basis functions, exemplary approaches for implementing such a auditory eigenfunction representation of the perception-modeled incoming acoustic audio will be given, for example in conjunction with future-described FIG. 26*a*, which provides a stream of time-varying coefficients.) Continuing with the model depicted in FIG. 19, the result of the hearing perception operation is a time-varying stream of symbols and/or parameters associated with an auditory eigenfunction representation of incoming audio as it is perceived by the human hearing mechanism. This time-varying stream of symbols and/or parameters is directed to further cognitive parsing and processing. This model can be used in various applications, for example, those involving speech analysis and representation, high-performance audio encoding, etc.

11. Exemplary Human Testing Approaches and Facilities

The invention provides for rendering the eigenfunctions as audio signals and to develop an associated signal handling and processing environment.

Figure 20:
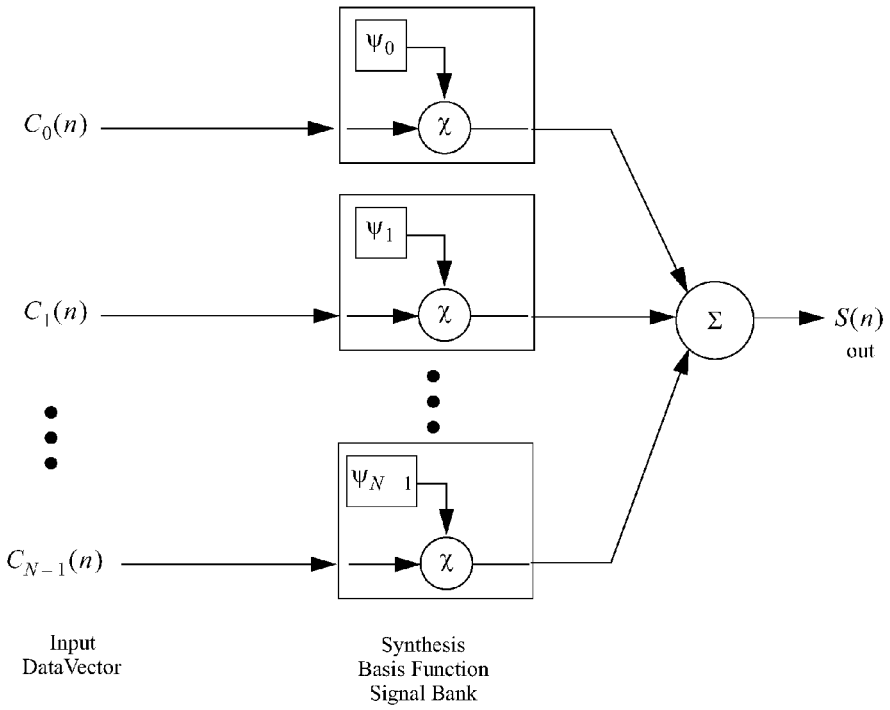
FIG. 20 depicts an exemplary arrangement that can be used as a step or component within an application or human testing facility.

FIG. 20 depicts an exemplary arrangement by which a stream of time-varying coefficients are presented to a synthesis basis function signal bank enabled to render auditory eigenfunction basis functions by at least time-varying amplitude control. In an embodiment the stream of time-varying coefficients can also control or be associated with aspects of basis function signal initiation timing. The resulting amplitude controlled (and in some embodiments, initiation timing controlled) basis function signals are then summed and directed to an audio output. In some embodiments, the summing may provide multiple parallel outputs, for example, as may be used in stereo audio output or the rendering of musical audio timbres that are subsequently separately processed further.

The exemplary arrangement of FIG. 20, and variations on it apparent to one skilled in the art, can be used as a step or component within an application.

Figure 21:
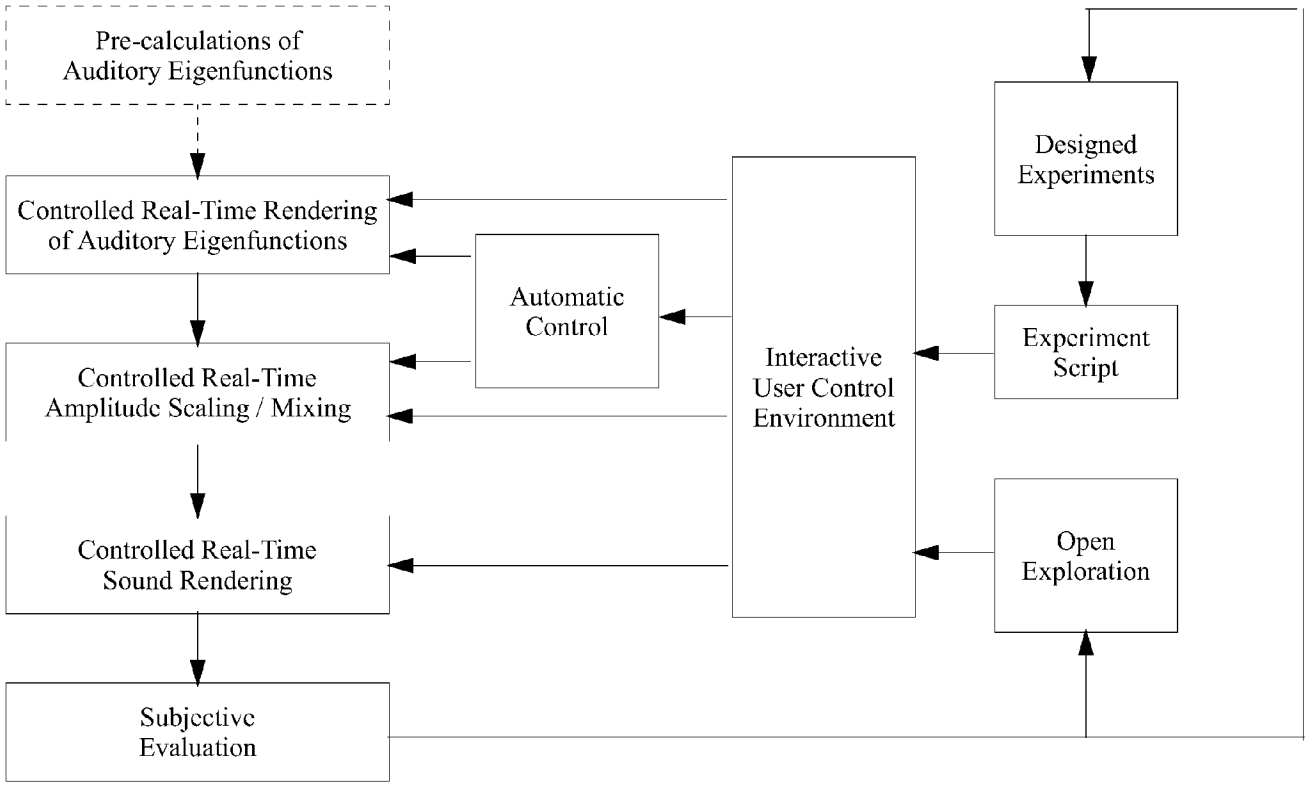
FIG. 21 depicts an exemplary human testing facility capable of supporting one or more types of study and application development activities, such as hearing, sound perception, language, subjective properties of auditory eigenfunctions, applications of auditory eigenfunctions, etc.

The exemplary arrangement of FIG. 20, and variations on it apparent to one skilled in the art, can also be used as a step or component within a human testing facility that can be used to study hearing, sound perception, language, subjective properties of auditory eigenfunctions, applications of auditory eigenfunctions, etc. FIG. 21 depicts an exemplary human testing facility capable of supporting one or more of these types of study and application development activities. In the left column, controlled real-time renderings, amplitude scaling, mixing and sound rendering are performed and presented for subjective evaluation. Regarding the center column, all of the controlled operations in the left column may be operated by an interactive user interface environment, which in turn may utilize various types of automatic control (file streaming, even sequencing, etc.). Regarding the right column, the interactive user interface environment may be operated according to, for example, by an experimental script (detailing for example a formally designed experiment) and/or by open experimentation. Experiment design and open experimentation can be influenced, informed, directed, etc. by real-time, recorded, and/or summarized outcomes of aforementioned subjective evaluation.

As described just above, the exemplary arrangement of FIG. 21 can be implemented and used in a number of ways. One of the first uses would be for the basic study of the auditory eigenfunctions themselves. An exemplary initial study plan could, for example, comprise the following steps:

A first step is to implement numerical representations, approximations, or sampled versions of at least a first few eigenfunctions which can be obtained and to confirm the resulting numerical representations as adequate approximate solutions. Mathematical software programs such as Mathematica™ [21] and MATLAB™ and associated techniques that can be custom coded (for example as in [54]) can be used. Slepian's own 1968 numerical techniques [25] as well as more modern methods (such as adaptations of the methods in [26]) can be used. A GUI-based user interface for the resulting system can be provided.

A next step is to render selected eigenfunctions as audio signals using the numerical representations, approximations, or sampled versions of model eigenfunctions produced in an earlier activity. In an embodiment, a computer with a sound card may be used. Sound output will be presentable to speakers and headphones. In an embodiment, the headphone provisions may include multiple headphone outputs so two or more project participants can listen carefully or binaurally at the same time. In an embodiment, a gated microphone mix may be included so multiple simultaneous listeners can exchange verbal comments yet still listen carefully to the rendered signals.

In an embodiment, an arrangement wherein groups of eigenfunctions can be rendered in sequences and/or with individual volume-controlling envelopes will be implemented.

In an embodiment, a comprehensive customized control environment is provided. In an embodiment, a GUI-based user interface is provided.

In a testing activity, human subjects may listen to audio renderings with an informed ear and topical agenda with the goal of articulating meaningful characterizations of the rendered audio signals. In another exemplary testing activity, human subjects may deliberately control rendered mixtures of signals to obtain a desired meaningful outcome. In another exemplary testing activity, human subjects may control the dynamic mix of eigenfunctions with user-provided time-varying envelopes. In another exemplary testing activity, each ear of human subjects may be provided with a controlled distinct static or dynamic mix of eigenfunctions. In another exemplary testing activity, human subjects may be presented with signals empirically suggesting unique types of spatial cues [32, 33]. In another exemplary testing activity, human subjects may control the stereo signal renderings to obtain a desired meaningful outcome.

12. Potential Applications

There are many potential commercial applications for the model and eigensystem; these include:

User/machine interfaces;
Audio compression/encoding;
Signal processing;
Data sonification;
Speech synthesis; and
Music timbre synthesis.

The underlying mathematics is also likely to have applications in other fields, and related knowledge in those other fields linked to by this mathematics may find applications in psychoacoustics, phonetics, and linguistics. Impacts on wider academic areas may include:

Perceptual science (including temporal effects in vision such as shimmering and frame-by-frame fusion in motion imaging);
Physics;
Theory of differential equations;
Tools of approximation;
Orthogonal polynomials;
Spectral analysis, including wavelet and time-frequency analysis frameworks; and,
Stochastic processes.

Exemplary applications are considered in more detail below.

12.1 Speech Models and Optimal Language Design Applications

In an embodiment, the eigensystem may be used for speech models and optimal language design. In that the auditory perception eigenfunctions represent or provide a mathematical coordinate system basis for auditory perception, they may be used to study properties of language and animal vocalizations. The auditory perception eigenfunctions may also be used to design one or more languages optimized from at least the perspective of auditory perception.

In particular, as the auditory perception eigenfunctions is, by its very nature, defined by the interplay of time limiting and band-pass phenomena, it is possible the Hilbert space model eigensystem may provide important new information regarding the boundaries of temporal variation and perceived frequency (for example as may occur in rapidly spoken languages, tonal languages, vowel guide [6-8], "auditory roughness" [2], etc.), as well as empirical formulations (such as critical band theory, phantom fundamental, pitch/loudness curves, etc.) [1,2].

Figure 22A:
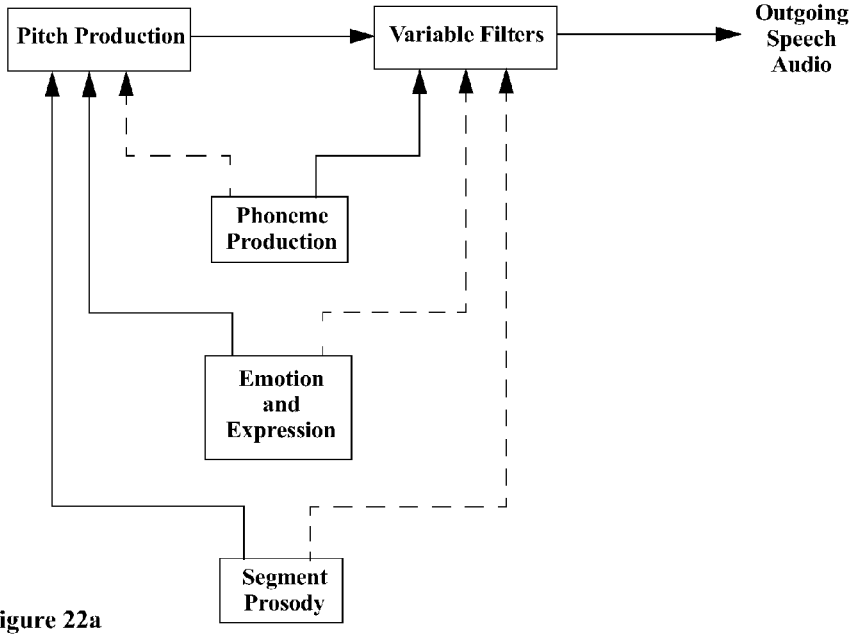
FIG. 22*a* depicts a speech production model for non-tonal spoken languages.

FIG. 22*a* depicts a speech production model for non-tonal spoken languages. Here typically emotion, expression, and prosody control pitch, but phoneme information does not. Instead, phoneme information controls variable signal filtering provided by the mouth, tongue, etc.

Figure 22B:
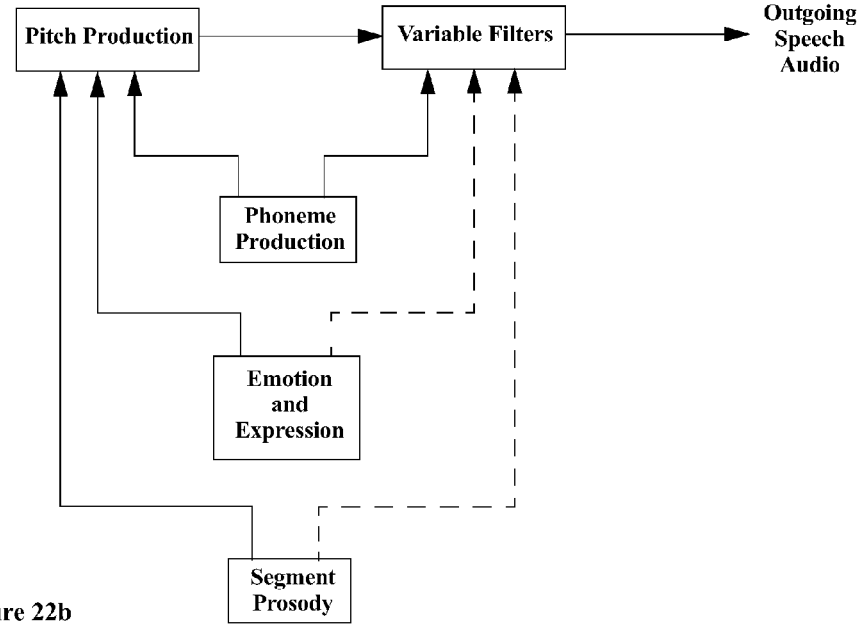
FIG. 22*b* depicts a speech production model for tonal spoken languages.

FIG. 22*b* depicts a speech production model for tonal spoken languages. Here phoneme information does control the pitch, causing pitch modulations. When spoken relatively quickly, the interplay among time and frequency aspects can become more prominent.

In both cases, rapidly spoken language involves rapid manipulation of the variable signal filter processes of the vocal apparatus. The resulting rapid modulations of the variable signal filter processes of the vocal apparatus for consonant and vowel production also create an interplay among time and frequency aspects of the produced audio.

Figure 23:
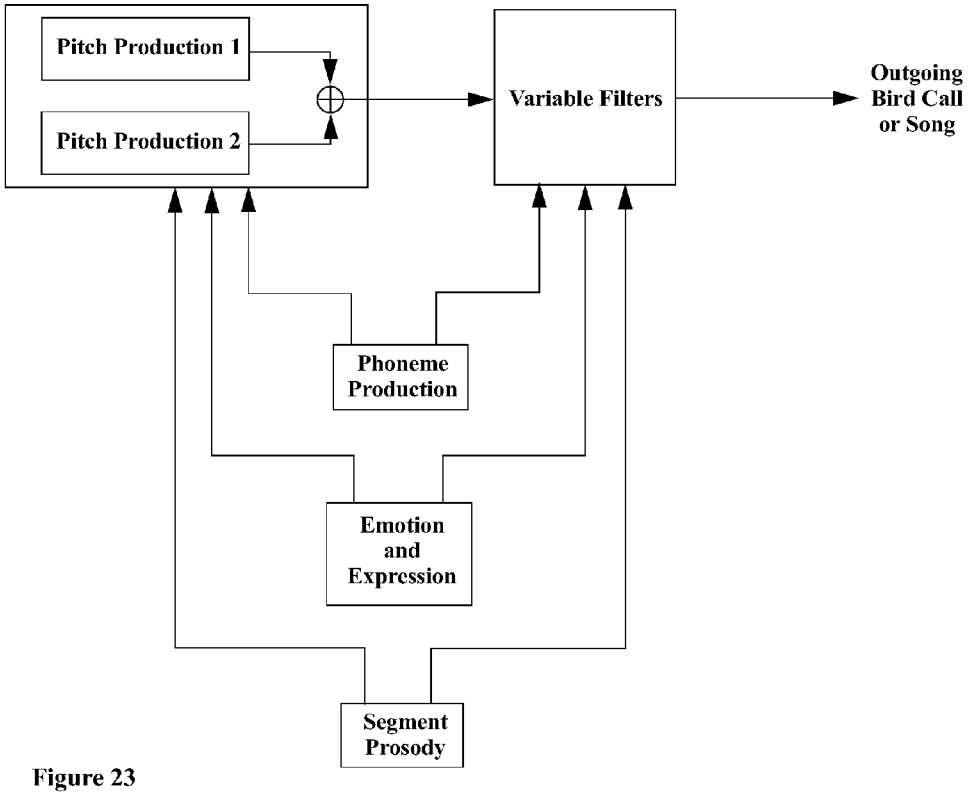
FIG. 23 depicts a bird call and/or bird song vocal production model.

FIG. 23 depicts a bird call and/or bird song vocal production model, albeit slightly anthropomorphic. Here, too, is a very rich environment involving interplay among time and frequency aspects, especially for rapid bird call and/or bird song vocal "phoneme" production. The situation is slightly more complex in that models of bird vocalization often include two pitch sources.

Figure 24:
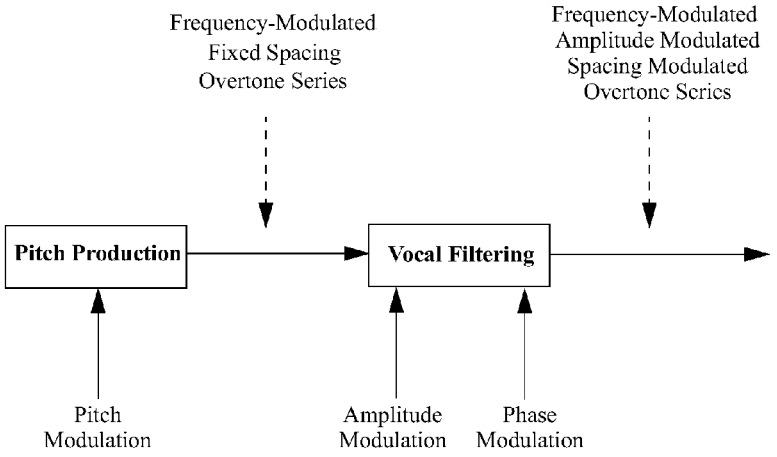
FIG. 24 depicts a general speech and vocalization production model that emphasizes generalized vowel and vowel-like-tone production that can be applied to the study human and animal vocal communications as well as other applications.

FIG. 24 depicts a general speech and vocalization production model that emphasizes generalized vowel and vowel-like-tone production. Rapid modulations of the variable signal filter processes of the vocal apparatus for vowel production also create an interplay among time and frequency aspects of the produced audio. Of particular interest are vowel glides [6-8] (including diphthongs and semi-vowels) where more temporal modulation occurs than in ordinary static vowels. This model may also be applied to the study or synthesis of animal vocal communications and in audio synthesis in electronic and computer musical instruments.

Figure 25:
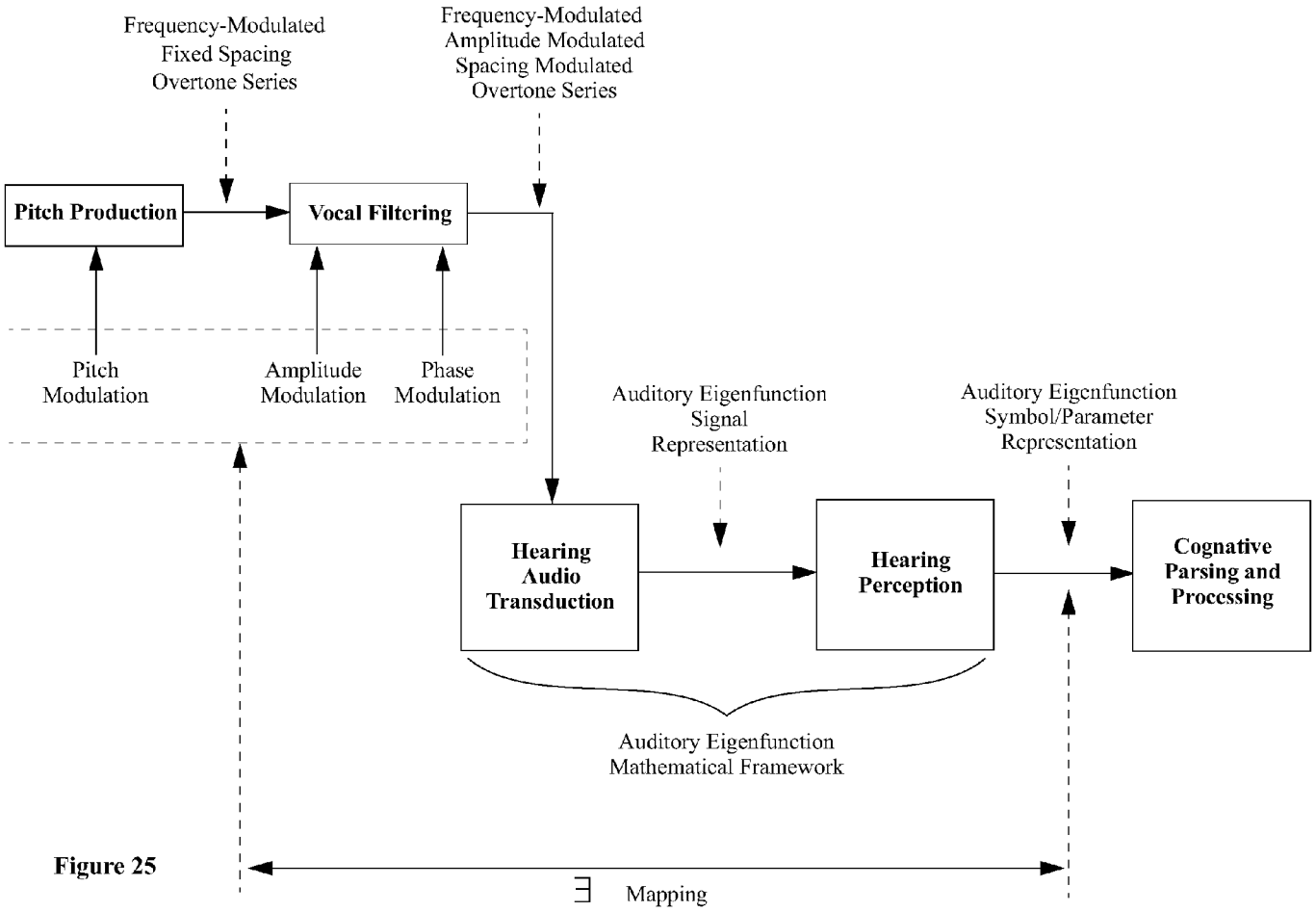
FIG. 25 depicts an exemplary arrangement for the study and modeling of various aspects of speech, animal vocalization, and other applications combining the general auditory eigenfunction hearing representation model of FIG. 19 and the general speech and vocalization production model of FIG. 24.

FIG. 25 depicts an exemplary arrangement for the study and modeling of various aspects of speech, animal vocalization, and other applications. The basic arrangement employs the general auditory eigenfunction hearing representation model of FIG. 19 (lower portion of FIG. 25) and the general speech and vocalization production model of FIG. 24 (upper portion of FIG. 25). In one embodiment or application setting, the production model akin to FIG. 24 is represented by actual vocalization or other incoming audio signals, and the general auditory eigenfunction hearing representation model akin to FIG. 19 is used for analysis. In another embodiment or application setting, the production model akin to FIG. 24 is synthesized under direct user or computer control, and the general auditory eigenfunction hearing representation model akin to FIG. 19 is used for associated analysis. For example, aspects of audio signal synthesis via production model akin to FIG. 24 can be adjusted in response to the analysis provided by the general auditory eigenfunction hearing representation model akin to FIG. 19.

Figure 26B:
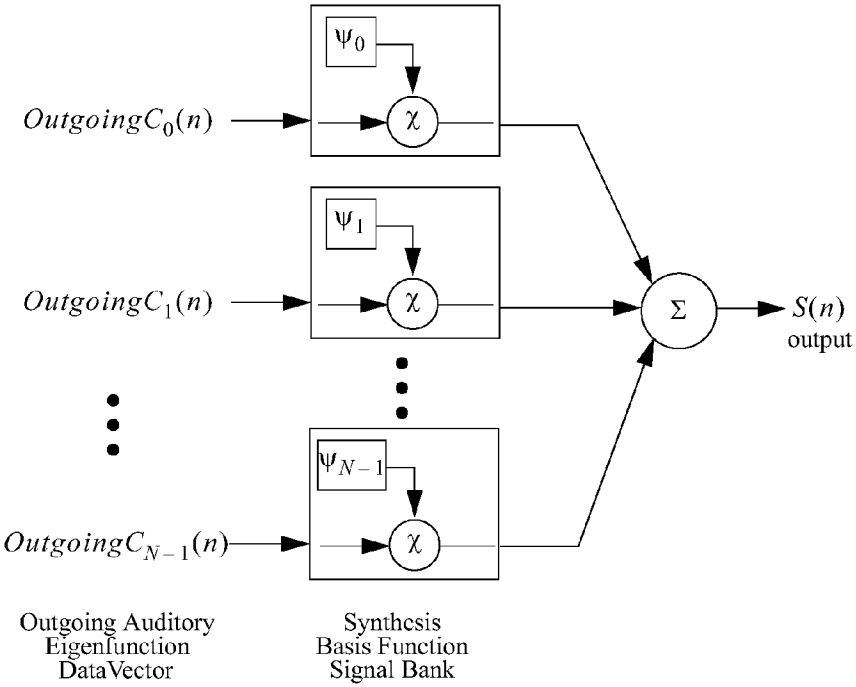
FIG. 26*b* depicts an exemplary synthesis arrangement, akin to that of FIG. 20, and that can be used as a component in the arrangement of FIG. 25, by which a stream of time-varying coefficients are presented to a synthesis basis function signal bank enabled to render auditory eigenfunction basis functions by at least time-varying amplitude control.
Figure 26A:
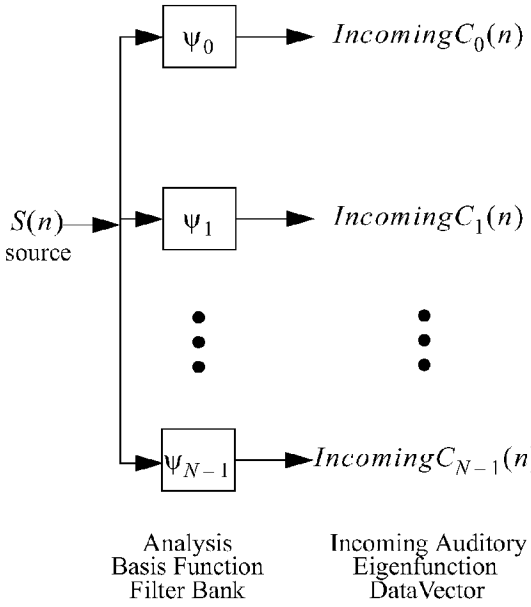
FIG. 26*a* depicts an exemplary analysis arrangement that can be used as a component in the arrangement of FIG. 25 wherein incoming audio information (such as an audio signal, audio stream, audio file, etc.) is provided in digital form S(n) to a filter analysis bank comprising filters, each filter comprising filter coefficients that are selectively tuned to a finite collection of separate distinct auditory eigenfunctions.

Further as to the exemplary arrangements of FIG. 24 and FIG. 25, FIG. 26*a* depicts an exemplary analysis arrangement wherein incoming audio information (such as an audio signal, audio stream, audio file, etc.) is provided in digital form S(n) to a filter analysis bank comprising filters, each filter comprising filter coefficients that are selectively tuned to a finite collection of separate distinct auditory eigenfunctions. The output of each filter is a time varying stream or sequence of coefficient values, each coefficient reflecting the relative amplitude, energy, or other measurement of the degree of presence of an associated auditory eigenfunction. As a particular or alternative embodiment, the analysis associated with each auditory eigenfunction operator element depicted in FIG. 26*a* can be implemented by performing an inner product operation on the combination of the incoming audio information and the particular associated auditory eigenfunction. The exemplary arrangement of FIG. 26*a* can be used as a component in the exemplary arrangement of FIG. 25.

Further as to the exemplary arrangements of FIG. 19 and FIG. 25, FIG. 26*b* depicts an exemplary synthesis arrangement, akin to that of FIG. 20, by which a stream of time-varying coefficients are presented to a synthesis basis function signal bank enabled to render auditory eigenfunction basis functions by at least time-varying amplitude control. In an embodiment the stream of time-varying coefficients can also control or be associated with aspects of basis function signal initiation timing. The resulting amplitude controlled (and in some embodiments, initiation timing controlled) basis function signals are then summed and directed to an audio output. In some embodiments, the summing may provide multiple parallel outputs, for example as may be used in stereo audio output or the rendering of musical audio timbres that are subsequently separately processed further. The exemplary arrangement of FIG. 26*b* can be used as a component in the exemplary arrangement of FIG. 25.

12.2 Data Sonification Applications

In an embodiment, the eigensystem may be used for data sonification, for example as taught in a pending patent in multichannel sonification (U.S. 61/268,856) and another pending patent in the use of such sonification in a complex GIS system for environmental science applications (U.S. 61/268,873). The invention provides for data sonification to employ auditory perception eigenfunctions to be used as modulation waveforms carrying audio representations of data. The invention provides for the audio rendering employing auditory eigenfunctions to be employed in a sonification system.

Figure 27:
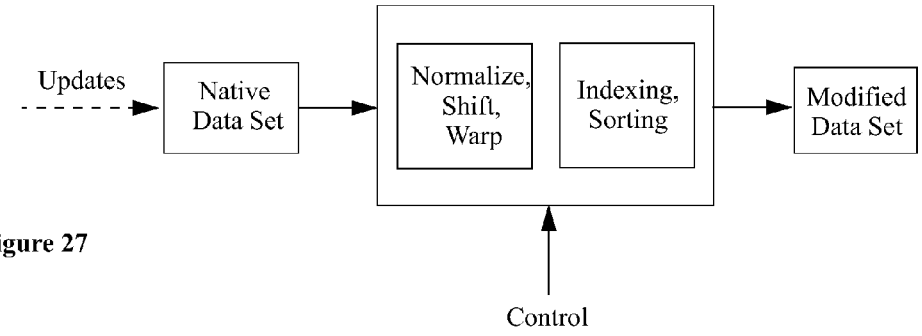
FIG. 27 shows a data sonification embodiment wherein a native data set is presented to normalization, shifting, (non-linear) warping, and/or other functions, index functions, and sorting functions

FIG. 27 shows a data sonification embodiment wherein a native data set is presented to normalization, shifting, (non-linear) warping, and/or other functions, index functions, and sorting functions. In some embodiments provided for by the invention, two or more of these functions may occur in various orders as may be advantageous or required for an application and produce a modified dataset. In some embodiments provided for by the invention, aspects of these functions and/or order of operations may be controlled by a user interface or other source, including an automated data formatting element or an analytic model. The invention further provides for embodiments wherein updates are provided to a native data set.

Figure 28:
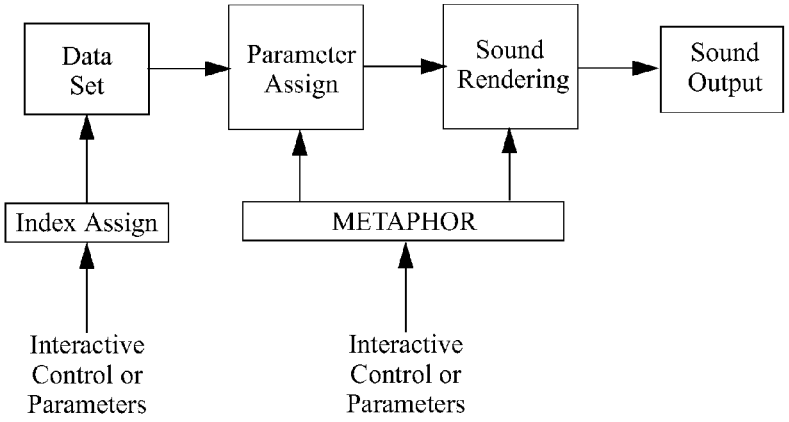
FIG. 28 shows a data sonification embodiment wherein interactive user controls and/or other parameters are used to assign an index to a data set.

FIG. 28 shows a data sonification embodiment wherein interactive user controls and/or other parameters are used to assign an index to a data set. The resultant indexed data set is assigned to one or more parameters as may be useful or required by an application. The resulting indexed parameter information is provided to a sound rendering operation resulting in a sound (audio) output. For traditional types of parameterized sound synthesis, mathematical software programs such as Mathematica™ [21] and MATLAB™ as well as sound synthesis software programs such as CSound™ [22] and associated techniques that can be custom coded (for example as in [23,24]) can be used.

The invention provides for the audio rendering employing auditory perception eigenfunctions to be rendered under the control of a data set. In embodiments provided for by the invention, the parameter assignment and/or sound rendering operations may be controlled by interactive control or other parameters. This control may be governed by a metaphor operation useful in the user interface operation or user experience. The invention provides for the audio rendering employing auditory perception eigenfunctions to be rendered under the control of a metaphor.

Figure 29:
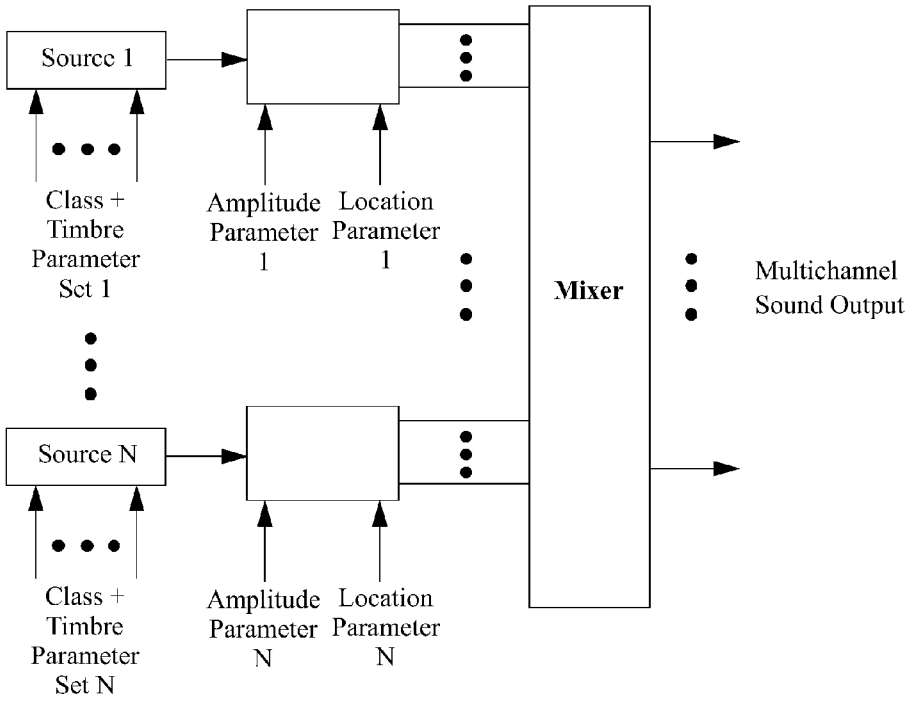
FIG. 29 shows a "multichannel sonification" employing data-modulated sound timbre classes set in a spatial metaphor stereo sound field.

FIG. 29 shows a "multichannel sonification" employing data-modulated sound timbre classes set in a spatial metaphor stereo soundfield. The outputs may be stereo, four-speaker, or more complex, for example employing 2D speaker, 2D headphone audio, or 3D headphone audio so as to provide a richer spatial-metaphor sonification environment. The invention provides for the audio rendering employing auditory perception eigenfunctions in any of a monaural, stereo, 2D, or 3D sound field.

Figure 30:
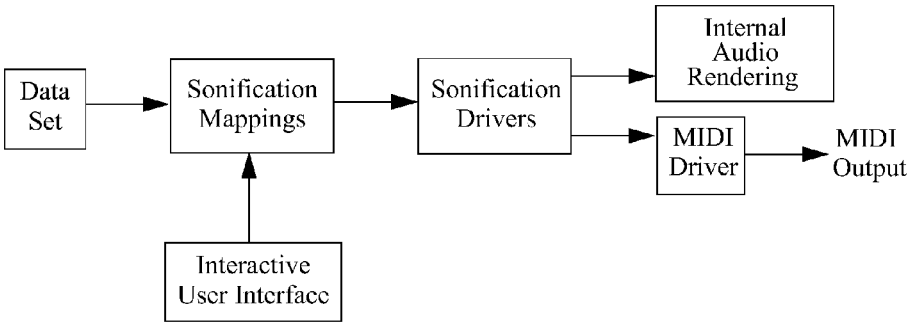
FIG. 30 shows a sonification rendering embodiment wherein a dataset is provided to exemplary sonification mappings controlled by interactive user interface.

FIG. 30 shows a sonification rendering embodiment wherein a dataset is provided to exemplary sonification mappings controlled by interactive user interface. Sonification mappings provide information to sonification drivers, which in turn provides information to internal audio rendering and/or a control signal (such as MIDI) driver used to control external sound rendering. The invention provides for the sonification to employ auditory perception eigenfunctions to produce audio signals for the sonification in internal audio rendering and/or external audio rendering. The invention provides for the audio rendering employing auditory perception eigenfunctions under MIDI control.

Figure 31:
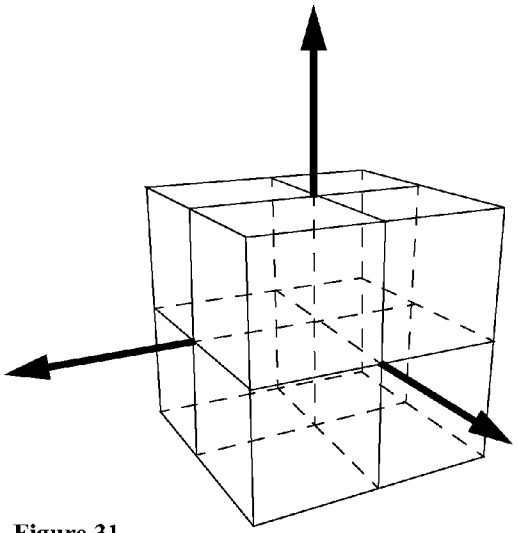
FIG. 31 shows an embodiment of a three-dimensional partitioned timbre space.

FIG. 31 shows an exemplary embodiment of a three-dimensional partitioned timbre space. Here the timbre space has three independent perception coordinates, each partitioned into two regions. The partitions allow the user to sufficiently distinguish separate channels of simultaneously produced sounds, even if the sounds time modulate somewhat within the partition as suggested by FIG. 32. The invention provides for the sonification to employ auditory perception eigenfunctions to produce and structure at least a part of the partitioned timbre space.

Figure 32:
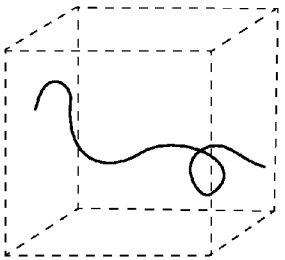
FIG. 32 depicts a trajectory of time-modulated timbral attributes within a partition of a timbre space.

FIG. 32 depicts an exemplary trajectory of time-modulated timbral attributes within a partition of a timbre space. Alternatively, timbre spaces may have 1, 2, 4 or more independent perception coordinates. The invention provides for the sonification to employ auditory perception eigenfunctions to produce and structure at least a portion of the timbre space so as to implement user-discernable time-modulated timbral through a timbre space.

The invention provides for the sonification to employ auditory perception eigenfunctions to be used in conjunction with groups of signals comprising a harmonic spectral partition. An example signal generation technique providing a partitioned timber space is the system and method of U.S. Pat. No. 6,849,795 entitled "Controllable Frequency-Reducing Cross-Product Chain." The harmonic spectral partition of the multiple cross-product outputs do not overlap. Other collections of audio signals may also occupy well-separated partitions within an associated timbre space. In particular, the invention provides for the sonification to employ auditory perception eigenfunctions to produce and structure at least a part of the partitioned timbre space.

Figure 33:
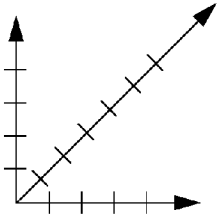
FIG. 33 depicts the partitioned coordinate system of a timbre space wherein each timbre space coordinate supports a plurality of partition boundaries.

Through proper sonic design, each timbre space coordinate may support several partition boundaries, as suggested in FIG. 33. FIG. 33 depicts the partitioned coordinate system of a timbre space wherein each timbre space coordinate supports a plurality of partition boundaries. Further, proper sonic design can produce timbre spaces with four or more independent perception coordinates. The invention provides for the sonification to employ auditory perception eigenfunctions to produce and structure at least a part of the partitioned timbre space.

Figure 34:
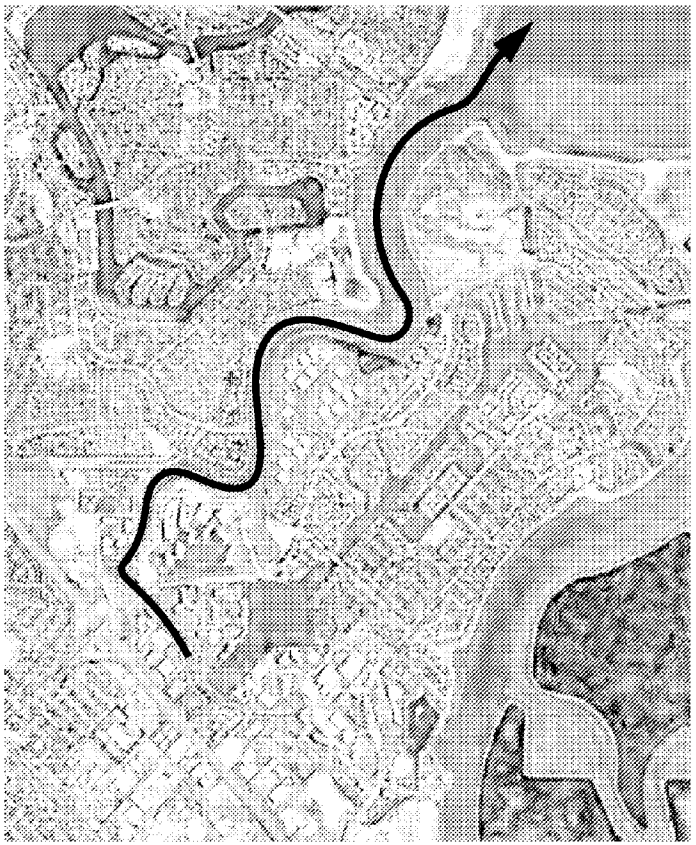
FIG. 34 depicts a data visualization rendering provided by a user interface of a GIS system depicting an aerial or satellite map image for a studying surface water flow path through a complex mixed-use area comprising overlay graphics such as a fixed or animated flow arrow.

FIG. 34 depicts a data visualization rendering provided by a user interface of a GIS system depicting am aerial or satellite map image for a studying surface water flow path through a complex mixed-use area comprising overlay graphics such as a fixed or animated flow arrow. The system may use data kriging to interpolate among one or more of stored measured data values, real-time incoming data feeds, and simulated data produced by calculations and/or numerical simulations of real world phenomena.

In an embodiment, a system may overlay visual plot items or portions of data, geometrically position the display of items or portions of data, and/or use data to produce one or more sonification renderings. For example, in an embodiment a sonification environment may render sounds according to a selected point on the flow path, or as a function of time as a cursor moves along the surface water flow path at a specified rate. The invention provides for the sonification to employ auditory perception eigenfunctions in the production of the data-manipulated sound.

12.3 Audio Encoding Applications

In an embodiment, the eigensystem may be used for audio encoding and compression.

Figure 35A:
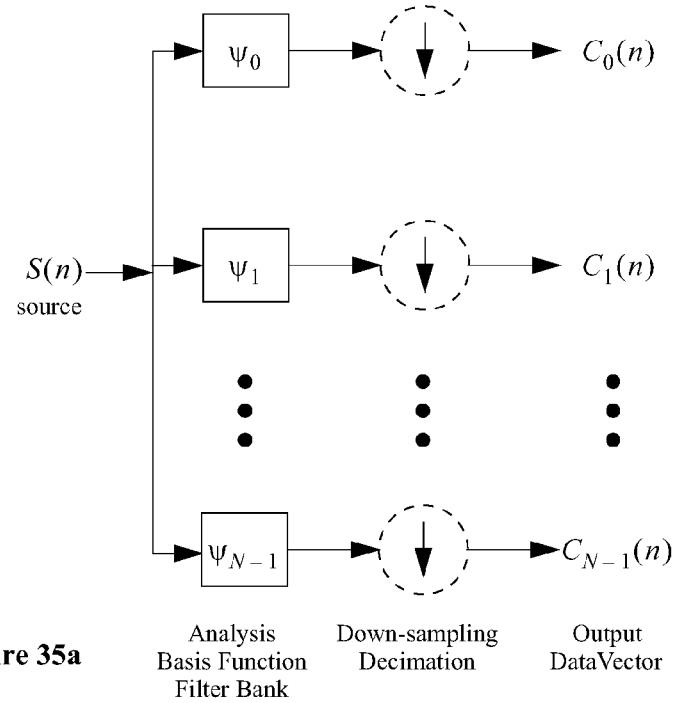
FIG. 35*a* depicts a filter-bank encoder employing orthogonal basis functions.

FIG. 35*a* depicts a filter-bank encoder employing orthogonal basis functions. In some embodiments, a down-sampling or decimation operation is used to manage, structure, and/or match data rates in and out of the depicted arrangement. The invention provides for auditory perception eigenfunctions to be used as orthogonal basis functions in an encoder. The encoder may be a filter-bank encoder.

Figure 35B:
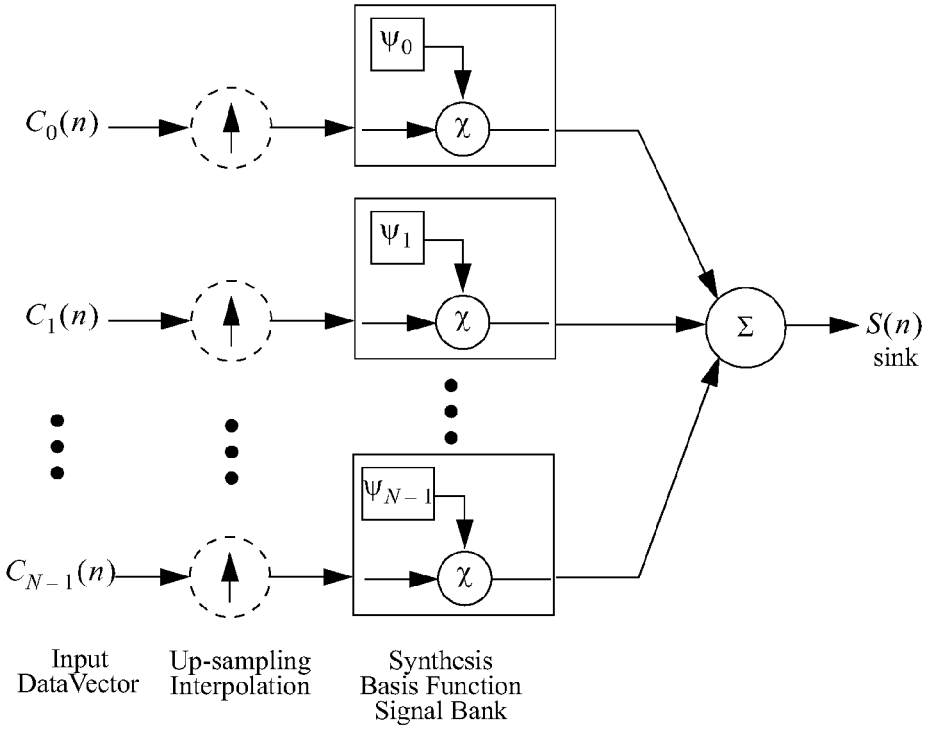
FIG. 35*b* depicts a signal-bank decoder employing orthogonal basis functions.

FIG. 35*b* depicts a signal-bank decoder employing orthogonal basis functions. In some embodiments an up-sampling or interpolation operation is used to manage, structure, and/or match data rates in and out of the depicted arrangement. The invention provides for auditory perception eigenfunctions to be used as orthogonal basis functions in a decoder. The decoder may be a signal-bank decoder.

Figure 36A:
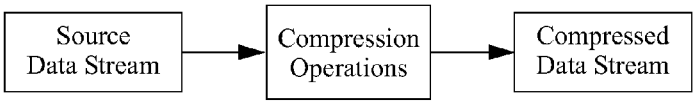
FIG. 36*a* depicts a data compression signal flow wherein an incoming source data stream is presented to compression operations to produce an outgoing compressed data stream.

FIG. 36*a* depicts a data compression signal flow wherein an incoming source data stream is presented to compression operations to produce an outgoing compressed data stream. The invention provides for the outgoing data vector of an encoder employing auditory perception eigenfunctions as basis functions to serve as the aforementioned source data stream.

The invention also provides for auditory perception eigenfunctions to provide a coefficient-suppression framework for at least one compression operation.

Figure 36B:
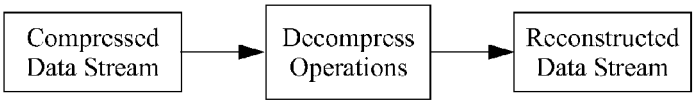
FIG. 36*b* depicts a decompression signal flow wherein an incoming compressed data stream is presented to decompress operations to produce an outgoing reconstructed data stream.

FIG. 36*b* depicts a decompression signal flow wherein an incoming compressed data stream is presented to decompress operations to produce an outgoing reconstructed data stream. The invention provides for the outgoing reconstructed data stream to serve as the input data vector for a decoder employing auditory perception eigenfunctions as basis functions.

Figure 37A:
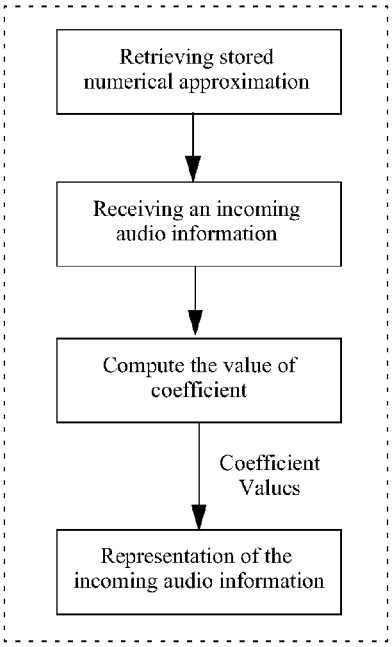
FIG. 37*a* depicts an exemplary encoder method for representing audio information with auditory eigenfunctions for use in conjunction with human hearing.

In an encoder embodiment, the invention provides methods for representing audio information with auditory eigenfunctions for use in conjunction with human hearing. An exemplary method is provided below and summarized in FIG. 37*a*.

An exemplary first step involves retrieving a plurality of approximations, each approximation corresponding with each of a plurality of eigenfunctions numerically calculated at an earlier time, each approximation having resulted from numerically approximating, on a computer or mathematical processing device, an eigenfunction equation representing a model of human hearing, the model comprising a bandpass operation with a bandwidth comprised by the frequency range of human hearing and a time-limiting operation approximating the duration of the time correlation window of human hearing;

An exemplary second step involves receiving an incoming audio information.

An exemplary third step involves using the approximation to each of a plurality of eigenfunctions as basis functions for representing the incoming audio information by mathematically processing the incoming audio information together with each of the retrieved approximations to compute the value of a coefficient that is associated with the corresponding eigenfunction and associated the time of calculation, the result comprising a plurality of coefficient values associated with the time of calculation.

The plurality of coefficient values can be used to represent at least a portion of the incoming audio information for an interval of time associated with the time of calculation. Embodiments may further comprise one or more of the following additional aspects:

The retrieved approximation associated with each of a plurality of eigenfunctions is a numerical approximation of a particular eigenfunction;

The mathematically processing comprises an inner-product calculation;

The retrieved approximation associated with each of a plurality of eigenfunctions is a filter coefficient;

The mathematically processing comprises a filtering calculation.

The incoming audio information can be an audio signal, audio stream, or audio file.

Figure 37B:
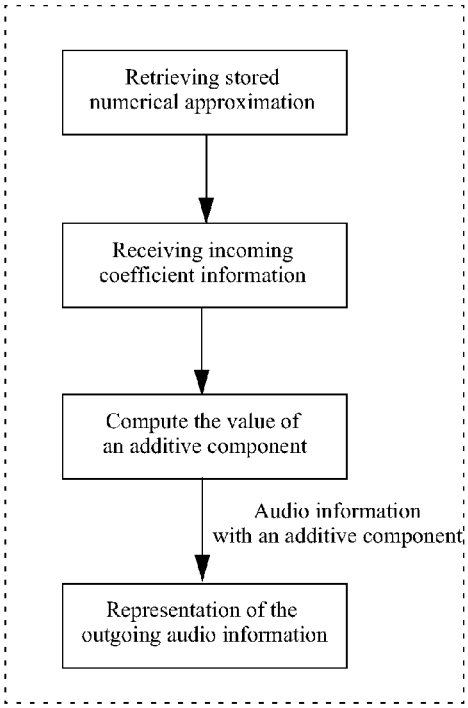
FIG. 37*b* depicts an exemplary decoder method for representing audio information with auditory eigenfunctions for use in conjunction with human hearing.

In a decoder embodiment, the invention provides a method for representing audio information with auditory eigenfunctions for use in conjunction with human hearing. An exemplary method is provided below and summarized in FIG. 37*b*.

An exemplary first step involves retrieving a plurality of approximations, each approximation corresponding with each of a plurality of eigenfunctions numerically calculated at an earlier time, each approximation having resulted from numerically approximating, on a computer or mathematical processing device, an eigenfunction equation representing a model of human hearing, the model comprising a bandpass operation with a bandwidth comprised by the frequency range of human hearing and a time-limiting operation approximating the duration of the time correlation window of human hearing.

An exemplary second step involves receiving incoming coefficient information.

An exemplary third step involves using the approximation to each of a plurality of eigenfunctions as basis functions for producing outgoing audio information by mathematically processing the incoming coefficient information together with each of the retrieved approximations to compute the value of an additive component to an outgoing audio information associated an interval of time, the result comprising a plurality of coefficient values associated with the time of calculation.

The plurality of coefficient values can be used to produce at least a portion of the outgoing audio information for an interval of time. Embodiments may further comprise one or more of the following additional aspects:

The retrieved approximation associated with each of a plurality of eigenfunctions is a numerical approximation of a particular eigenfunction;

The mathematically processing comprises an amplitude calculation;

The retrieved approximation associated with each of a plurality of eigenfunctions is a filter coefficient;

The mathematically processing comprises a filtering calculation.

The outgoing audio information can be an audio signal, audio stream, or audio file.

12.4 Music Analysis and Electronic Musical Instrument Applications

In an embodiment, the auditory eigensystem basis functions may be used for music sound analysis and electronic musical instrument applications. As with tonal languages, of particular interest is the study and synthesis of musical sounds with rapid timbral variation.

In an embodiment, an adaptation of arrangements of FIG. 25 and/or FIG. 26*a* may be used for the analysis of musical signals.

In an embodiment, an adaptation of arrangement of FIG. 19 and/or FIG. 26*b* for the synthesis of musical signals.

CLOSING

While the invention has been described in detail with reference to disclosed embodiments, various modifications within the scope of the invention will be apparent to those of ordinary skill in this technological field. It is to be appreciated that features described with respect to one embodiment typically can be applied to other embodiments.

The invention can be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein. Therefore, the invention properly is to be construed with reference to the claims.

REFERENCES

[1] Winckel, F., *Music, Sound and Sensation: A Modern Exposition*, Dover Publications, 1967.

[2] Zwicker, E.; Fastl, H., *Psychoacoustics: Facts and Models*, Springer, 2006.

[3] Slepian, D.; Pollak, H., "Prolate Spheroidal Wave Functions, Fourier Analysis and Uncertainty—I:" *The Bell Systems Technical Journal*, pp. 43-63, January 1960.

[4] Landau, H.; Pollak, H., "Prolate Spheroidal Wave Functions, Fourier Analysis and Uncertainty—II," *The Bell Systems Technical Journal*, pp. 65-84, January 1961.

[5] Landau, H.; Pollak, H., "Prolate Spheroidal Wave Functions, Fourier Analysis and Uncertainty—III: The Dimension of the Space of Essentially Time- and Band-Limited Signals," *The Bell Systems Technical Journal*, pp. 1295-1336, July 1962.

[6] Rosenthall, S., *Vowel/Glide Alternation in a Theory of Constraint Interaction* (Outstanding Dissertations in Linguistics), Routledge, 1997.

[7] Zhang, J., *The Effects of Duration and Sonority on Contour Tone Distribution: A Typological Survey and Formal Analysis* (Outstanding Dissertations in Linguistics), Routledge, 2002.

[8] Rosner, B.; Pickering, J., *Vowel Perception and Production* (Oxford Psychology Series), Oxford University Press, 1994.

[9] Senay, S.; Chaparro, L.; Akan, A., "Sampling and Reconstruction of Non-Bandlimitted Signals Using Slepian Functions," Department of Electrical and Computer Engineering, University of Pittsburgh <http://www.eurasip.org/Proceedings/Eusipco/Eusipco2008/papers/1569102318.pdf>.

[10] Baur, O.; Sneeuv, N., "The Slepian approach revisited: dealing with the polar gap in satellite based geopotential recovery," University Stuttgart, 2006 <http://earth.esa.int/workshops/goce06/participants/260/pres_sneeu_260.pdf>.

[11] Morrison, J., "On the commutation of finite integral operators, with difference kernels, and linear selfadjoint differential operators," *Abstract, Not. AMS*, pp. 119, 1962.

[12] Morrison, J., "On the Eigenfunctions Corresponding to the Bandpass Kernel, in the Case of Degeneracy," *Quarterly of Applied Mathematics*, vol. 21, no. 1, pp. 13-19, April, 1963.

[13] Morrison, J., "Eigenfunctions of the Finite Fourier Transform Operator Over A Hyperellipsoidal Region," *Journal of Mathematics and Physics*, vol. 44, no. 3, pp. 245-254, September, 1965.

[14] Morrison, J., "Dual Formulation for the Eigenfunctions Corresponding to the Bandpass Kernel, in the Case of Degeneracy," *Journal of Mathematics and Physics*, vol. XLIV, no. 4, pp. 313-326, December, 1965.

[15] Widom, H., "Asymptotic Behavoir of the Eigenvalues of Certain Integral Equations," *Rational Mechanics and Analysis*, vol. 2, pp. 215-229, Springer, 1964.

[16] DARPA, "Acoustic Signal Source Separation and Localization," SBIR Topic Number SB092-009, 2009 (cached at <http://74.125.155.132/search?q=cache:G7LmA8VAFGIJ:www.dodsbir.net/SITIS/display_topic.asp%3FBookmark%3D35493+SB092-009&cd=1&hl=en&ct=clnk&gl=us)>

[17] Cooke, M., *Modelling Auditory Processing and Organisation*, Cambridge University Press, 2005.

[18] Norwich, K., *Information, Sensation, and Perception*, Academic Press, 1993.

[19] Todd, P.; Loy, D., *Music and Connectionism*, MIT Press, 1991.

[20] Xiao, H., "Prolate spheroidal wavefunctions, quadrature and interpolation," Inverse Problems, vol. 17, pp. 805-838, 2001, <http://www.iop.org/EJ/article/0266-5611/17/4/315/ip1415.pdf>.

[21] *Mathematica*®, Wolfram Research, Inc., 100 Trade Center Drive, Champaign, Ill. 61820-7237.

[22] Boulanger, R. *The Csound Book: Perspectives in Software Synthesis, Sound Design, Signal Processing, and Programming*, MIT Press, 2000.

[23] De Ploi, G.; Piccialli, A.; Roads, C., *Representations of Musical Signals*, MIT Press, 1991.

[24] Roads, C., *The Computer Music Tutorial*, MIT Press, 1996.

[25] Slepian, D., "A Numerical Method for Determining the Eigenvalues and Eigenfunctions of Analytic Kernels," *SIAM J. Numer. Anal.*, Vol. 5, No, 3, September 1968.

[26] Walter, G.; Soleski, T., "A New Friendly Method of Computing Prolate Spheroidal Wave Functions and Wavelets," *Appl. Comput. Harmon. Anal.* 19, 432-443. <http://www.ima.umn.edu/~soleski/PSWFcomputation.pdf>

[27] Walter, G.; Shen, X., "Wavelet Like Behavior of Slepian Functions and Their Use in Density Estimation," *Communications in Statistics—Theory and Methods*, Vol. 34, Issue 3, March 2005, pages 687-711.

[28] Hartmann, W., *Signals, Sound, and Sensation*, Springer, 1997.

[29] Krasichkov, I., "Systems of functions with the dual orthogonality property, *Mathematical Notes* (*Matematicheskie Zametki*), Vol. 4, No. 5, pp. 551-556, Springer, 1968 <http://www.springerlink.com/content/h574703536177127/fulltextpdf>.

[30] Seip, K., "Reproducing Formulas and Double Orthogonality in Bargmann and Bergman Spaces," *SIAM J. MATH. ANAL.*, Vol. 22, No. 3, pp. 856-876, May 1991.

[31] Bergman, S., *The Kernel Function and Conformal Mapping* (Math. Surveys V), American Mathematical Society, New York, 1950.

[32] Blauert, J., *Spatial Hearing—Revised Edition: The Psychophysics of Human Sound Localization*, MIT Press, 1996.

[33] Altman, J., *Sound localization: Neurophysiological Mechanisms* (Translations of the Beltone Institute for Hearing Research), Beltone Institute for Hearing Research, 1978.

[34] Wiener, N., *The Fourier Integral and Certain of Its Applications*, Dover Publications, Inc., New York, 1933 (1958 reprinting).

[35] Khare, K.; George, N., "Sampling Theory Approach to Prolate Spheroidal Wave Functions," *J. Phys.* A 36, 2003.

[36] Kohlenberg, A., "Exact Interpolation of Band-Limited Functions," *J. Appl. Phys.* 24, pp. 1432-1436, 1953.

[37] Slepian, D., "Some Comments on Fourier Analysis, Uncertainty, and Modeling," *SIAM Review*, Vol. 25, Issue 3, pp. 379-393, 1983.

[38] Khare, K., "Bandpass Sampling and Bandpass Analogues of Prolate Spheroidal Functions," *The Institute of Optics*, University of Rochester, Elsevier, 2005.

[39] Pei, S.; Ding, J., "Generalized Prolate Spheroidal Wave Functions for Optical Finite Fractional Fourier and Linear Canonical Transforms," *J. Opt. Soc. Am.*, Vol. 22, No. 3, 2005.

[40] Forester, K.-H.; Nagy, B.,"Linear Independence of Jordan Chains" in *Operator Theory and Analysis: The M. A. Kaashoek Anniversary Volume, Workshop in Amsterdam, Nov.* 12-14, 1997, Birhauser, Basel, 2001.

[41] Daubechies, I., "Time-Frequency Localization Operators: A Geometric Phase Space Approach," *IEEE Transactions on Information Theory*, Vol. 34, No. 4, 1988.

[42] Hlawatsch, F.; Boudreaux-Bartels, G., "Linear and Quadratic Time-Frequency Signal Representations," *IEEE SP Magazine,* 1992.

[43] Lyon, R.; Mead, C., "An Analog Electronic Cochlea," *IEEE Trans. Acoust., Speech, and Signal Processing*, vol. 36, no. 7, July 1988.

[44] Liu, W.; Andreou, A.; Goldstein, M., "Analog VLSI Implementation of an Auditory Periphery Model," in *Conf. Informat. Sci. and Syst.,* 1991.

[45] Watts, L.; Kerns, D.; Lyon, R.; Mead, C., "Improved Implementation of the Silicon Cochlea," *IEEE J. Solid-State Circuits*, vol. 27, No. 5, pp. 692-700, May 1992.

[46] Yang, X.; Wang, K.; Shamma, A., "Auditory Representations of Acoustic signals," *IEEE Trans. Information Theory*, vol. 2, pp. 824-839, March 1992.

[47] Lin, J.; Ki, W.-H., Edwards, T.; Shamma, S., "Analog VLSI Implementations of Auditory Wavelet Transforms Using Switched-Capacitor Circuits," *IEEE Trans. Circuits and Systems—I: Fundamental Theory and Applications*, vol. 41, no. 9, pp. 572-582, September 1994.

[48] Salimpour, Y.; Abolhassani, M., "Auditory Wavelet Transform Based on Auditory Wavelet Families," *EMBS Annual International Conference*, New York, ThEP3.17, 2006.

[49] Salimpour, Y.; Abolhassani, M.; Soltanian-Zadeh, H., "Auditory Wavelet Transform," *European Medical and Biological Engineering Conference*, Prague, 2005.

[50] Karmaka, A.; Kumar, A.; Patney, R., "A Multiresolution Model of Auditory

Excitation Pattern and Its Application to Objective Evaluation of Perceived Speech Quality," *IEEE Trans. Audio, Speech, and Language Processing*, vol. 14, no. 6, pp. 1912-1923, November 2006.

[51] Huber, R.; Kollmeier, B., "PEMO-Q—A New Method for Objective Audio Quality Assessment Using a Model of Auditory Perception," *IEEE Trans. Audio, Speech, and Language Processing*, vol. 14, no. 6, pp. 1902-1911, November 2006.

[52] Namias, v., "The Fractional Order Fourier Transform and its Application to Quantum Mechanics," *J. of Institute of Mathematics and Applications*, vol. 25, pp. 241-265, 1980.

[53] Ludwig, L. F. "General Thin-Lens Action on Spatial Intensity (Amplitude) Distribution Behaves as Non-Integer Powers of the Fourier Transform," *SPIE Spatial Light Modulators and Applications Conference*, South Lake Tahoe, 1988.

[53] Ozaktas; Zalevsky, Kutay, *The Fractional Fourier Transform*, Wiley, 2001 (ISBN 0471963461).

[54] Press, W.; Flannery, B.; Teukolsky, S.; Vetterling, W., *Numerical Recipes in C: The Art of Scientific Computing*, Cambridge University Press, 1988.

I claim:

1. A computer numerical processing method for representing audio information for use in conjunction with human hearing, the method comprising:

using a processing device for approximating an eigenfunction equation representing a model of human hearing, wherein the model comprises a bandpass operation with a bandwidth including the frequency range of human hearing and a time-limiting operation approximating the time duration correlation window of human hearing;

calculating the approximation to each of a plurality of eigenfunctions from at least one aspect of the eigenfunction equation; and storing the approximation to each of the plurality of eigenfunctions for use at a later time, wherein the approximation to each of the plurality of eigenfunctions represents audio information.

2. The method of claim 1 wherein the eigenfunction equation is a Slepian's bandpass-kernel integral equation.

3. The method of claim 1 wherein the approximation to each of the plurality of eigenfunctions comprises an approximation of a convolution of a prolate spheroidal wavefunction with a trigonometric function.

4. A method for representing audio information for use in conjunction with human hearing, the method comprising:

using a processing device for retrieving a plurality of approximations, each approximation corresponding with one of a plurality of eigenfunctions previously calculated, each approximation having resulted from approximating an eigenfunction equation representing a model of human hearing, wherein the model comprises a bandpass operation with a bandwidth including the frequency range of human hearing and a time-limiting operation approximating the time duration correlation window of human hearing;

receiving incoming audio information; and using the approximation to each of the plurality of eigenfunctions to represent the incoming audio information by mathematically processing the incoming audio information together with each of the retrieved approximations to compute a coefficient associated with the corresponding eigenfunction and associated the time of calculation, the result comprising a plurality of coefficient values associated with the time of calculation, wherein the plurality of coefficient values is used to represent at least a portion of the incoming audio information for an interval of time associated with the time of calculation.

5. The method of claim 4 wherein the retrieved approximation associated with each of the plurality of eigenfunctions is a numerical approximation of a particular eigenfunction.

6. The method of claim 5 wherein the mathematically processing comprises an inner-product calculation.

7. The method of claim 4 wherein the retrieved approximation associated with each of the plurality of eigenfunctions is a filter coefficient.

8. The method of claim 7 wherein the mathematically processing comprises a filtering calculation.

9. The method of claim 4 wherein the incoming audio information is an audio signal.

10. The method of claim 4 wherein the incoming audio information is an audio stream.

11. The method of claim 4 wherein the incoming audio information is an audio file.

12. A method for representing audio information for use in conjunction with human hearing, the method comprising:

using a processing device for retrieving a plurality of approximations, each approximation corresponding with one of a plurality of eigenfunctions previously calculated, each approximation having resulted from approximating an eigenfunction equation representing a model of human hearing, wherein the model comprises a bandpass operation with a bandwidth including the frequency range of human hearing and a time-limiting operation approximating the time duration correlation window of human hearing;

receiving incoming coefficient information; and using the approximation to each of the plurality of eigenfunctions to produce outgoing audio information by mathematically processing the incoming coefficient information together with each of the retrieved approximations to compute the value of an additive component to an outgoing audio information associated an interval of time, the result comprising a plurality of coefficient values associated with the calculation time, wherein the plurality of coefficient values is used to produce at least a portion of the outgoing audio information for an interval of time.

13. The method of claim 12 wherein the retrieved approximation associated with each of the plurality of eigenfunctions is a numerical approximation of a particular eigenfunction.

14. The method of claim 13 wherein the mathematically processing comprises an amplitude calculation.

15. The method of claim 12 wherein the retrieved approximation associated with each of the plurality of eigenfunctions is a filter coefficient.

16. The method of claim 15 wherein the mathematically processing comprises a filtering calculation.

17. The method of claim 12 wherein the outgoing audio information is an audio signal.

18. The method of claim 12 wherein the outgoing audio information is an audio stream.

19. The method of claim 12 wherein the outgoing audio information is an audio file.

* * * * *

UNITED STATES PATENT AND TRADEMARK OFFICE

CERTIFICATE OF CORRECTION

PATENT NO. : 8,620,643 B1
APPLICATION NO. : 12/849013
DATED : December 31, 2013
INVENTOR(S) : Lester F. Ludwig It is certified that error appears in the above-identified patent and that said Letters Patent is hereby corrected as shown below:

In the Specification

Column 16, lines 23-24, "8.1 Numerical Calculation Of Eigenfunctions For Bandpass Kernal Case", should be deleted.

Column 18, lines 3-26, "8.2. Alternative Construction Employing Khare Construction
As an alternative to the approach constructed thus far, Khare [38] provides a set of functions described as 'bandpass analogues of prolate spheroidal wave functions,' henceforth referred to by Khare's acronym "BPSF:" Khare shows these provide many aspects ([38], section 4) that while structured for other uses can be adapted for employment in the auditory eigenfunction concept at least as an approximation. Khare provides computation results ([38], section 5) and develops these BPSF from a construction of the PSWFs using the Whittaker-Shannon sampling theorem.
Ideally in each case additional adaptations are made to address the gradual transition bands shown in Figure 1b. Since develops the BPSF from a construction of the PSWFs using the Whittaker-Shannon sampling theorem, the horizontal linkage through the Whittaker-Shannon sampling theorem is also depicted.", should be deleted.

Column 18, line 27, delete "10." and insert --9.--.

Column 20, line 31, delete "11." and insert --10.--.

Column 21, line 60, delete "12." and insert --11.--.

Column 22, line 18, delete "12.1" and insert --11.1--.

Column 23, line 59, delete "12.2" and insert --11.2--.

Column 25, line 54, delete "12.3" and insert --11.3--.

Column 27, line 40, delete "12.4" and insert --11.4--.

Signed and Sealed this
Eighteenth Day of March, 2014

Michelle K. Lee

Michelle K. Lee
*Deputy Director of the United States Patent and Trademark Office*